US011694617B2

(12) United States Patent
Yoon et al.

(10) Patent No.: US 11,694,617 B2
(45) Date of Patent: Jul. 4, 2023

(54) IMAGE PROCESSING DEVICE AND IMAGE PROCESSING METHOD FOR HIGH RESOLUTION DISPLAY, AND APPLICATION PROCESSOR INCLUDING THE SAME

(71) Applicant: SAMSUNG ELECTRONICS CO., LTD., Suwon-si (KR)

(72) Inventors: Sungchul Yoon, Hwaseong-si (KR); Inyup Kang, Nonsan-si (KR); Hoonmo Yang, Hwaseong-si (KR); Kyungah Jeong, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 165 days.

(21) Appl. No.: 17/215,507

(22) Filed: Mar. 29, 2021

(65) Prior Publication Data

US 2022/0068201 A1 Mar. 3, 2022

(30) Foreign Application Priority Data

Aug. 31, 2020 (KR) ..... 10-2020-0110041

(51) Int. Cl.
*G09G 3/3233* (2016.01)
*G09G 3/20* (2006.01)

(52) U.S. Cl.
CPC ..... *G09G 3/3233* (2013.01); *G09G 3/2003* (2013.01); *G09G 2320/0666* (2013.01); *G09G 2340/06* (2013.01); *G09G 2340/10* (2013.01); *G09G 2340/12* (2013.01)

(58) Field of Classification Search
CPC ..... G09G 3/3233; G09G 3/2003; G09G 2320/0666; G09G 2340/06; G09G 2340/10; G09G 2340/12
See application file for complete search history.

(56) References Cited

U.S. PATENT DOCUMENTS

| | | | |
|---|---|---|---|
| 6,020,897 | A | 2/2000 | Carlsen et al. |
| 6,400,844 | B1 | 6/2002 | Fan et al. |
| 6,466,210 | B1 | 10/2002 | Carlsen et al. |
| 7,379,063 | B2 | 5/2008 | Hoff |
| 7,405,716 | B2 | 7/2008 | Lee et al. |

(Continued)

FOREIGN PATENT DOCUMENTS

JP 5603202 B2 10/2014

*Primary Examiner* — Robert J Michaud
(74) *Attorney, Agent, or Firm* — Sughrue Mion, PLLC

(57) ABSTRACT

An image processing device includes a blender and a display quality enhancer. The blender is configured to receive a plurality of layer data, generate first image data by blending the plurality of layer data, the first image data including a plurality of pixel values corresponding to a screen in a display device, and generate pixel map data including a plurality of pixel identifications (IDs) based on the plurality of layer data, the plurality of layer data representing a plurality of images to be displayed on the screen, the plurality of pixel IDs indicating display quality enhancement algorithms to be applied to the plurality of pixel values. The display quality enhancer is configured to generate second image data including a plurality of display quality enhancement pixel values by applying the display quality enhancement algorithms to the plurality of pixel values based on the first image data and the pixel map data.

20 Claims, 31 Drawing Sheets

(56) References Cited

U.S. PATENT DOCUMENTS

| | | | | |
|---|---|---|---|---|
| 8,497,881 | B2 | 7/2013 | Roh et al. | |
| 8,786,783 | B2 | 7/2014 | Park | |
| 9,811,932 | B2 | 11/2017 | Staudenmaier et al. | |
| 10,509,618 | B2 | 12/2019 | Chun | |
| 10,565,672 | B2 | 2/2020 | Kim et al. | |
| 2015/0104074 | A1* | 4/2015 | Vondran, Jr. | G06T 5/002 382/106 |
| 2018/0293713 | A1* | 10/2018 | Vogels | G06K 9/627 |
| 2019/0052908 | A1* | 2/2019 | Mertens | H04N 19/102 |
| 2020/0134792 | A1* | 4/2020 | Mandal | H04N 1/4074 |

* cited by examiner

FIG. 3

200

| | | | | | | | |
|---|---|---|---|---|---|---|---|
| P11 | P12 | P13 | P14 | P15 | P16 | P17 | P18 |
| P21 | P22 | P23 | P24 | P25 | P26 | P27 | P28 |
| P31 | P32 | P33 | P34 | P35 | P36 | P37 | P38 |
| P41 | P42 | P43 | P44 | P45 | P46 | P47 | P48 |
| P51 | P52 | P53 | P54 | P55 | P56 | P57 | P58 |
| P61 | P62 | P63 | P64 | P65 | P66 | P67 | P68 |
| P71 | P72 | P73 | P74 | P75 | P76 | P77 | P78 |
| P81 | P82 | P83 | P84 | P85 | P86 | P87 | P88 |
| P91 | P92 | P93 | P94 | P95 | P96 | P97 | P98 |
| PA1 | PA2 | PA3 | PA4 | PA5 | PA6 | PA7 | PA8 |
| PB1 | PB2 | PB3 | PB4 | PB5 | PB6 | PB7 | PB8 |
| PC1 | PC2 | PC3 | PC4 | PC5 | PC6 | PC7 | PC8 |

FIG. 7A

PMAP

| | | | | | | | |
|---|---|---|---|---|---|---|---|
| ID_11 | ID_12 | ID_13 | ID_14 | ID_15 | ID_16 | ID_17 | ID_18 |
| ID_21 | ID_22 | ID_23 | ID_24 | ID_25 | ID_26 | ID_27 | ID_28 |
| ID_31 | ID_32 | ID_33 | ID_34 | ID_35 | ID_36 | ID_37 | ID_38 |
| ID_41 | ID_42 | ID_43 | ID_44 | ID_45 | ID_46 | ID_47 | ID_48 |
| ID_51 | ID_52 | ID_53 | ID_54 | ID_55 | ID_56 | ID_57 | ID_58 |
| ID_61 | ID_62 | ID_63 | ID_64 | ID_65 | ID_66 | ID_67 | ID_68 |
| ID_71 | ID_72 | ID_73 | ID_74 | ID_75 | ID_76 | ID_77 | ID_78 |
| ID_81 | ID_82 | ID_83 | ID_84 | ID_85 | ID_86 | ID_87 | ID_88 |
| ID_91 | ID_92 | ID_93 | ID_94 | ID_95 | ID_96 | ID_97 | ID_98 |
| ID_A1 | ID_A2 | ID_A3 | ID_A4 | ID_A5 | ID_A6 | ID_A7 | ID_A8 |
| ID_B1 | ID_B2 | ID_B3 | ID_B4 | ID_B5 | ID_B6 | ID_B7 | ID_B8 |
| ID_C1 | ID_C2 | ID_C3 | ID_C4 | ID_C5 | ID_C6 | ID_C7 | ID_C8 |

FIG. 7B

PMAP1

| | | | | | | | |
|---|---|---|---|---|---|---|---|
| c | c | c | c | c | c | c | c |
| b | b | b | b | b | b | b | b |
| b | b | g | b | e | e | b | b |
| b | f | g | f | f | f | f | b |
| b | f | g | f | f | f | f | b |
| b | b | g | b | e | e | b | b |
| b | b | b | b | b | b | b | b |
| b | b | b | b | b | b | b | b |
| b | d | d | d | d | d | d | b |
| b | d | d | d | d | d | d | b |
| b | b | b | b | b | b | b | b |
| a | a | a | a | a | a | a | a |

FIG. 7C

PMAP2

| | | | | | | | |
|---|---|---|---|---|---|---|---|
| c | c | c | c | c | c | c | c |
| b | b | b | b | b | b | b | b |
| b | b | g1 | b | e1 | e1 | b | b |
| b | f1 | g1 | f1 | f2 | f2 | f2 | b |
| b | f1 | g2 | f1 | f2 | f2 | f2 | b |
| b | b | g2 | b | e2 | e2 | b | b |
| b | b | b | b | b | b | b | b |
| b | b | b | b | b | b | b | b |
| b | d1 | d1 | d1 | d2 | d2 | d2 | b |
| b | d1 | d1 | d1 | d2 | d2 | d2 | b |
| b | b | b | b | b | b | b | b |
| a | a | a | a | a | a | a | a |

FIG. 9

PMAP'

| | | | | | | | |
|---|---|---|---|---|---|---|---|
| | | | | | | | |
| | | | | | | | |
| | | ID_33 | | ID_35 | ID_36 | | |
| | ID_42 | ID_43 | ID_44 | ID_45 | ID_46 | ID_47 | |
| | ID_52 | ID_53 | ID_54 | ID_55 | ID_56 | ID_57 | |
| | | ID_63 | | ID_65 | ID_66 | | |
| | | | | | | | |
| | | | | | | | |
| | ID_92 | ID_93 | ID_94 | ID_95 | ID_96 | ID_97 | |
| | ID_A2 | ID_A3 | ID_A4 | ID_A5 | ID_A6 | ID_A7 | |
| | | | | | | | |
| | | | | | | | |

FIG. 16

BMAP

| | | | | | | | |
|---|---|---|---|---|---|---|---|
| BID_11 | BID_12 | BID_13 | BID_14 | BID_15 | BID_16 | BID_17 | BID_18 |
| BID_21 | BID_22 | BID_23 | BID_24 | BID_25 | BID_26 | BID_27 | BID_28 |
| BID_31 | BID_32 | BID_33 | BID_34 | BID_35 | BID_36 | BID_37 | BID_38 |
| BID_41 | BID_42 | BID_43 | BID_44 | BID_45 | BID_46 | BID_47 | BID_48 |
| BID_51 | BID_52 | BID_53 | BID_54 | BID_55 | BID_56 | BID_57 | BID_58 |
| BID_61 | BID_62 | BID_63 | BID_64 | BID_65 | BID_66 | BID_67 | BID_68 |

IMAGE PROCESSING DEVICE AND IMAGE PROCESSING METHOD FOR HIGH RESOLUTION DISPLAY, AND APPLICATION PROCESSOR INCLUDING THE SAME

CROSS-REFERENCE TO THE RELATED APPLICATION

This application is based on and claims priority under 35 USC § 119 to Korean Patent Application No. 10-2020-0110041, filed on Aug. 31, 2020 in the Korean Intellectual Property Office (KIPO), the disclosure of which is incorporated by reference herein in its entirety.

BACKGROUND

1. Field

Example embodiments of the disclosure relate to semiconductor integrated circuits, and more particularly to image processing devices and image processing methods for high resolution display, and application processors including the image processing devices.

2. Description of the Related Art

As information technology continues to develop, a display device plays a vital role in providing information to a user. Various display devices such as liquid crystal displays (LCDs), plasma displays, and electroluminescent displays have gained popularity. Among these display devices, electroluminescent displays generally have quick response speeds and reduced power consumption, and use light-emitting diodes (LEDs) or organic light-emitting diodes (OLEDs) that emit light through recombination of electrons and holes.

Recently, as the resolution of display devices increases and a pixel per inch (PPI) is improved, there are demands for quality enhancement or improvement of the display devices. For example, a multi-window, in which multiple applications are displayed on one screen, has become popular, and requires the display quality enhancement for each type of images, and thus various schemes have been researched for the display quality enhancement.

SUMMARY

Provided is an image processing device and an image processing method capable of applying a display quality enhancement algorithm to suit an actual screen displayed on a high resolution display device.

Also, provided an application processor including the image processing device.

According to an exemplary embodiment, there is provided an image processing device including at least one processor configured to implement: a blender configured to: receive a plurality of layer data; generate first image data by blending the plurality of layer data, the first image data including a plurality of pixel values corresponding to one screen in a display device; and generate pixel map data including a plurality of pixel identifications (IDs) based on the plurality of layer data, the plurality of layer data representing a plurality of images to be displayed on the one screen in the display device, the plurality of pixel IDs indicating one or more display quality enhancement algorithms to be applied to the plurality of pixel values; and a display quality enhancer configured to generate second image data including a plurality of display quality enhancement pixel values by applying the one or more display quality enhancement algorithms to the plurality of pixel values based on the first image data and the pixel map data.

According to an exemplary embodiment, there is provided an image processing method. The method includes receiving a plurality of layer data, the plurality of layer data representing a plurality of images to be displayed on one screen in a display device; generating first image data by blending the plurality of layer data, the first image data including a plurality of pixel values corresponding to the one screen; generating pixel map data including a plurality of pixel identifications (IDs) based on the plurality of layer data, the plurality of pixel IDs indicating one or more display quality enhancement algorithms to be applied to the plurality of pixel values; and generating second image data including a plurality of display quality enhancement pixel values by applying the one or more display quality enhancement algorithms to the plurality of pixel values based on the first image data and the pixel map data.

According to an exemplary embodiment, there is provided an application processor including: at least one processor and a display controller configured to be interoperable with the at least one processor. The display controller includes a high dynamic range (HDR) unit configured to receive a plurality of layer data from the at least one processor, and to perform a HDR processing on the plurality of layer data based on a first control signal, the plurality of layer data representing a plurality of images to be displayed on one screen in a display device; a blender configured to generate first image data by blending the plurality of layer data based on an output of the HDR unit and a second control signal; and generate pixel map data including a plurality of pixel identifications (IDs) based on the output of the HDR unit and the second control signal, the first image data including a plurality of pixel values corresponding to the one screen, the plurality of pixel IDs indicating one or more display quality enhancement algorithms to be applied to the plurality of pixel values; a display quality enhancer configured to generate second image data including a plurality of display quality enhancement pixel values by applying the one or more display quality enhancement algorithms to the plurality of pixel values based on the first image data and the pixel map data; a register configured to receive at least one meta data corresponding to at least one of the plurality of layer data from the at least one processor; and generate the first control signal, the second control signal and a third control signal based on the at least one meta data; and a frame rate control unit configured to control a frame rate of the display device based on the third control signal.

According to an exemplary embodiment, there is provided an image processing device including at least one processor configured to implement: a blender configured to receive a plurality of layer data; generate first image data by blending the plurality of layer data, the first image data including a plurality of pixel values corresponding to one screen of a display device; and generate block map data including a plurality of block identifications (IDs) based on the plurality of layer data, the plurality of layer data representing a plurality of images to be displayed on the one screen of the display device, the plurality of block IDs indicating one or more display quality enhancement algorithms to be applied to the plurality of pixel values; and a display quality enhancer configured to generate second image data including a plurality of display quality enhancement pixel values by applying the one or more display quality enhancement algorithms to a plurality of blocks based on the first image data and the block map data, wherein the display device includes a plurality of pixels, and each of the plurality of pixel values correspond to a respective one of the plurality of pixels, and wherein two or more of the plurality of pixels are grouped to form each of the plurality of blocks, and each of the plurality of block IDs corresponds to a respective one of the plurality of blocks.

BRIEF DESCRIPTION OF THE DRAWINGS

The above and other aspects, features and advantages of the present embodiments will become apparent from the following description, taken in conjunction with the accompanying drawings, in which:

FIGS. 3, 4, 5A, 5B, 5C, 5D, 5E, 5F, 5G, 6, 7A, 7B, 7C, 8, 9, 10A and 10B are diagrams for describing an operation of an image processing device according to one or more exemplary embodiments;

FIG. 16 is a diagram for describing an operation of an image processing device according to an exemplary embodiment;

DETAILED DESCRIPTION

Figure 1:
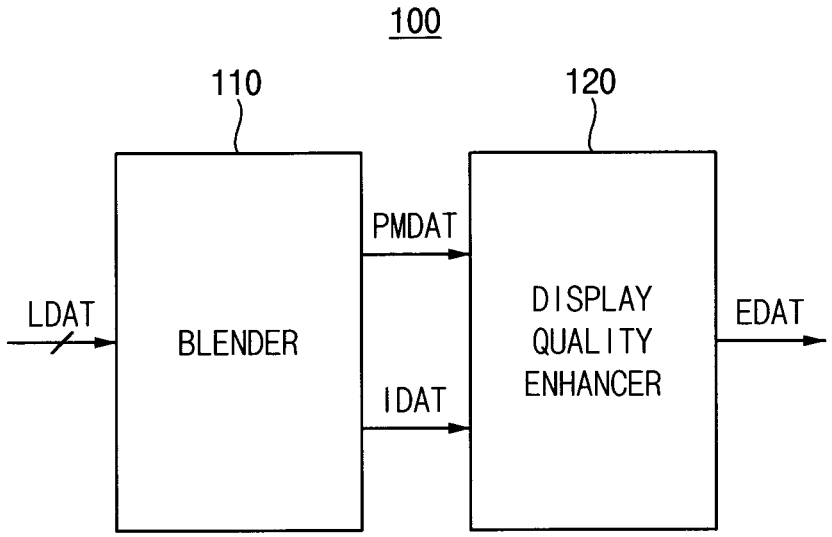
FIG. 1 is a block diagram illustrating an image processing device according to an exemplary embodiment.

Various example embodiments will be described in more detail with reference to the accompanying drawings, in which one or more embodiments are shown. The present disclosure may, however, be embodied in many different forms and should not be construed as limited to the embodiments set forth herein. Like reference numerals refer to like elements throughout the disclosure.

It will be understood that when an element or layer is referred to as being "over," "above," "on," "below," "under," "beneath," "connected to" or "coupled to" another element or layer, it can be directly over, above, on, below, under, beneath, connected or coupled to the other element or layer or intervening elements or layers may be present. In contrast, when an element is referred to as being "directly over," "directly above," "directly on," "directly below," "directly under," "directly beneath," "directly connected to" or "directly coupled to" another element or layer, there are no intervening elements or layers present. Like numerals refer to like elements throughout.

The expression "at least one of a, b, and c," should be understood as including only a, only b, only c, both a and b, both a and c, both b and c, or all of a, b, and c. The terms such as "first", "second", or the like may be used to modify various elements regardless of order and/or importance, and to simply distinguish one element from another element.

The term used in the one or more embodiments of the disclosure such as "unit" or "module" indicates a unit for processing at least one function or operation, and may be implemented in hardware, software, or in a combination of hardware and software.

The term "unit" or "module" may be implemented by a program that is stored in an addressable storage medium and executable by a processor.

For example, the term "unit" or "module" may include software components, object-oriented software components, class components and task components, processes, functions, attributes, procedures, subroutines, segments of a program code, drivers, firmware, microcode, circuitry, data, databases, data structures, tables, arrays, and/or variables.

FIG. 1 is a block diagram illustrating an image processing device according to an exemplary embodiment.

Referring to FIG. 1, an image processing device 100 includes a blender 110 and a display quality enhancer 120.

The blender 110 receives a plurality of layer data LDAT. The plurality of layer data LDAT represent a plurality of images to be displayed on one screen in a display device (or a display panel). For example, the plurality of images may be displayed to partially and/or entirely overlap on the one screen of the display device, and each of the plurality of layer data LDAT may correspond to a respective one of the plurality of images. Each of the plurality of images may be referred to as a layer, a layer image and/or a partial image. A more detailed description of the plurality of layer data LDAT will follow with reference to FIG. 4 below.

The blender 110 generates first image data IDAT by blending the plurality of layer data LDAT. The first image data IDAT includes a plurality of pixel values corresponding to the one screen. For example, the display device may include a plurality of pixels, and each of the plurality of pixels may have a respective one of the plurality of pixel values. For example, each of the plurality of pixel values may include a grayscale value, a luminance value and/or a brightness value of a respective one of the plurality of pixels. Similarly, each of the plurality of layer data LDAT may include pixel values corresponding to a respective one of the plurality of images. A more detailed description for blending the plurality of layer data LDAT will follow with reference to FIGS. 3 and 4.

Blending represents an operation of calculating a pixel value that is actually displayed among several layers (e.g., images) constituting one screen. When the blending is performed, a pixel value that is actually displayed on each pixel may be obtained. For example, when only one layer is disposed, arranged or placed on a pixel, a pixel value included in the one layer may be obtained as it is. When two or more layers are disposed on a pixel, a pixel value included in one layer among the two or more layers may be obtained, or a new pixel value may be obtained based on pixel values included in the two or more layers. The blending may be referred to as mixing and/or composition.

The blender 110 generates pixel map data PMDAT based on the plurality of layer data LDAT. The pixel map data PMDAT includes a plurality of pixel identifications (IDs) that represent display quality enhancement algorithms (or image quality improvement algorithms) to be applied to the plurality of pixel values. For example, as will be described with reference to FIG. 7 below, each of the plurality of pixels may have a respective one of the plurality of pixel IDs. For example, each pixel ID for each pixel may be set based on blending information (e.g., what pixel value is actually obtained for each pixel by the blending). Each of the plurality of pixel IDs may be referred to as a display quality enhancement algorithm setting ID or the like.

The display quality enhancer 120 generates second image data EDAT by applying different display quality enhancement algorithms to the plurality of pixel values based on the first image data IDAT and the pixel map data PMDAT. The second image data EDAT includes a plurality of display quality enhancement pixel values. For example, as with the plurality of pixel values, each of the plurality of pixels may have a respective one of the plurality of display quality enhancement pixel values. The plurality of pixels may emit light based on the plurality of display quality enhancement pixel values to display an image corresponding to the one screen.

In the image processing device 100 according to example embodiments, the blending may be performed on several layers constituting one screen, the pixel IDs may be generated, and the pixel map data PMDAT, which is a set of the pixel IDs, may be generated. Each pixel ID may represent an optimal (or optimized) display quality enhancement algorithm to be applied to each pixel value obtained as a result of the blending. In addition, optimal display quality enhancement algorithms may be applied to the plurality of pixels based on the pixel map data PMDAT, and different display quality enhancement algorithms may be applied by units of pixels. Accordingly, the optimal display quality may be realized for each pixel, and the display quality may be enhanced or improved.

Figure 2:
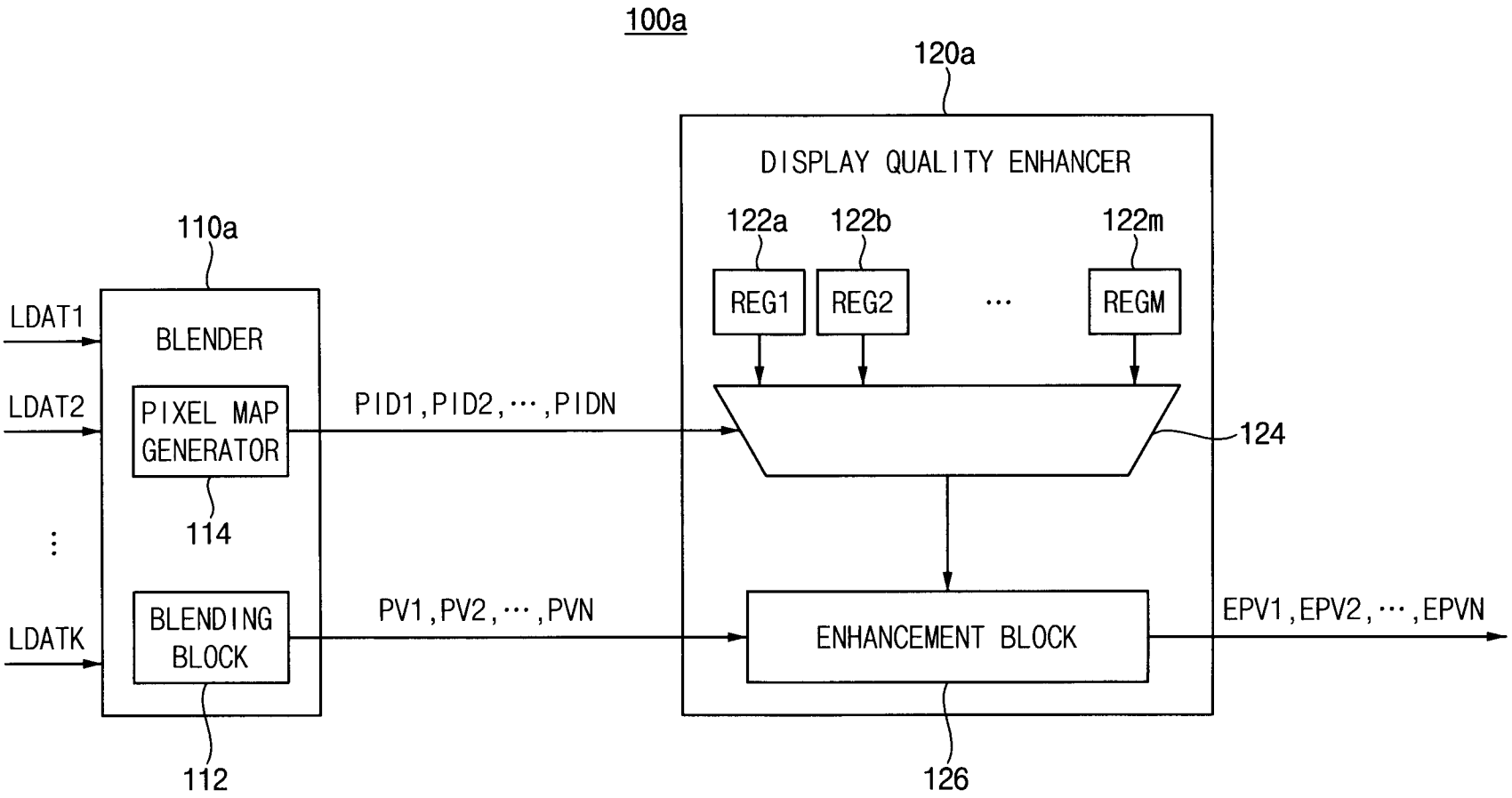
FIG. 2 is a block diagram illustrating an image processing device of FIG. 1 in detail, according to an exemplary embodiment.

FIG. 2 is a block diagram illustrating an image processing device of FIG. 1 in detail, according to an exemplary embodiment. The descriptions already provided with respect to FIG. 1 will be omitted.

Referring to FIG. 2, an image processing device 100*a* includes a blender 110*a* and a display quality enhancer 120*a*.

In an example of FIG. 2, the plurality of layer data LDAT may include first through K-th layer data LDAT1, LDAT2, . . . , LDATK, and the plurality of images may include first through K-th images, where K is a natural number greater than or equal to two. In addition, the plurality of pixel values included in the first image data IDAT may include first through N-th pixel values PV1, PV2, . . . , PVN, the plurality of pixel IDs included in the pixel map data PMDAT may include first through N-th pixel IDs PID1, PID2, . . . , PIDN, and the plurality of display quality enhancement pixel values included in the second image data EDAT may include first through N-th display quality enhancement pixel values EPV1, EPV2, . . . , EPVN, where N is a natural number greater than or equal to two. Further, the plurality of display quality enhancement algorithms applicable to each pixel value may include first through M-th display quality enhancement algorithms, where M is a natural number greater than or equal to two.

The blender 110*a* may include a blending block 112 and a pixel map generator 114.

The blending block 112 may generate the first through N-th pixel values PV1, PV2, . . . , PVN corresponding to one composite image (or mixed image) to be actually displayed on the one screen by synthesizing the first through K-th images based on the first through K-th layer data LDAT1, LDAT2, . . . , LDATK. For example, the blending block 112 may determine an arrangement of the layers. That is, the blending block 112 may determine which layer is disposed above and which layer is disposed below. For example, the blending block 112 may determine a scheme of displaying the layers, such as only the uppermost layer is displayed or a layer disposed above is displayed as semi-transparent or translucent to partially display a layer disposed below. For example, the blending block 112 may obtain or acquire the first through N-th pixel values PV1, PV2, . . . , PVN constituting one composite image based on the above-described determinations.

The pixel map generator 114 may generate the first through N-th pixel IDs PID1, PID2, . . . , PIDN for the first through N-th pixel values PV1, PV2, . . . , PVN corresponding to the one composite image based on the first through K-th layer data LDAT1, LDAT2, . . . , LDATK. For example, the pixel map generator 114 may set each pixel ID based on each pixel value included in each layer. For example, the first pixel ID PID1 may correspond to the first pixel value PV1, the second pixel ID PID2 may correspond to the second pixel value PV2, and the N-th pixel ID PIDN may correspond to the N-th pixel value PVN.

In some example embodiments, when two or more images are overlapped and disposed on a first pixel corresponding to the first pixel value PV1, e.g., when the first pixel corresponds to two or more layer data, the pixel map generator 114 may generate the first pixel ID PID1 corresponding to the first pixel value PV1 based on one of the two or more layer data.

In some example embodiments, pixel IDs corresponding to pixel values included in the same layer may have the same value. In other words, the same pixel ID may be set for each layer. However, example embodiments are not limited thereto. In other example embodiments, some of pixel IDs corresponding to pixel values included in the same layer may have different values, or some of pixel IDs corresponding to pixel values included in different layers may have the same value.

The display quality enhancer 120 may include a plurality of registers (REG1, REG2, . . . , REGM) 122*a*, 122*b*, . . . , 122*m*, a multiplexer 124 and an enhancement block 126.

The plurality of registers 122*a*, 122*b*, . . . , 122*m* may store a plurality of display quality enhancement parameters for the first through M-th display quality enhancement algorithms. For example, the first register 122*a* may store at least one display quality enhancement parameter for the first display quality enhancement algorithm, the second register 122*b* may store at least one display quality enhancement parameter for the second display quality enhancement algorithm, and the M-th register 122*m* may store at least one display quality enhancement parameter for the M-th display quality enhancement algorithm.

In some example embodiments, each of the plurality of registers 122*a*, 122*b*, . . . , 122*m* may be a configuration register, and may include, for example, a special function register (SFR). The plurality of display quality enhancement parameters may be stored in the plurality of registers 122*a*, 122*b*, . . . , 122*m* in the form of a lookup table (LUT), or may be stored in various ways representing the display quality enhancement algorithms.

In some example embodiments, the plurality of display quality enhancement algorithms may include a detail enhancement (DE), a scaling (or scaler), an adaptive tone map control (ATC), a hue saturation control (HSC), a gamma and a de-gamma, an Android open source project (AOSP), a color gamut control (CGC), a dithering (or dither), a round corner display (RCD), a sub-pixel rendering (SPR), or the like. The DE may represent an algorithm for sharpening an outline of an image. The scaling may represent an algorithm that changes a size of an image. The ATC may represent an algorithm for improving the outdoor visibility. The HSC may represent an algorithm for improving the hue and saturation for color. The gamma may represent an algorithm for gamma correction or compensation. The AOSP may represent an algorithm for processing an image conversion matrix (e.g., a mode for a color-impaired person or a night mode) defined by the Android OS. The CGC may represent an algorithm for matching color coordinates of a display panel. The dithering may represent an algorithm for expressing the effect of color of high bits using limited colors. The RCD may represent an algorithm for processing rounded corners of a display panel. The SPR may represent an algorithm for increasing the resolution. However, example embodiments are not limited thereto, and the plurality of display quality enhancement algorithms may further include various other algorithms.

The multiplexer 124 may select at least one of the first through M-th display quality enhancement algorithms based on the first through N-th pixel IDs PID1, PID2, PIDN. For example, the multiplexer 124 may select at least one display quality enhancement algorithm for the first pixel value PV1 based on the first pixel ID PID1. The multiplexer 124 may select at least one display quality enhancement algorithm for the second pixel value PV2 based on the second pixel ID PID2. The multiplexer 124 may select at least one display quality enhancement algorithm for the N-th pixel value PVN based on the N-th pixel ID PIDN.

In some example embodiments, only one of the first through M-th display quality enhancement algorithms may be selected for one pixel based on one pixel ID. In other example embodiments, two or more of the first through M-th display quality enhancement algorithms may be selected for one pixel based on one pixel ID.

In some example embodiments, each of the first through N-th pixel IDs PID1, PID2, . . . , PIDN may include M bits, and at least one of the first through M-th display quality enhancement algorithms may be selected based on each bit value indicated in the N-th pixel ID. For example, the first pixel ID PID1 may include first through M-th bits, and at least one display quality enhancement algorithm corresponding to a bit having a value of "1" among the first through M-th bits may be selected. For example, the first through M-th bits may correspond to the first through M-th display quality enhancement algorithms, respectively. When only the first bit has a value of "1," only the first display quality enhancement algorithm may be selected for the first pixel value PV1. When both the first bit and a second bit have a value of "1," both the first and second display quality enhancement algorithms may be selected for the first pixel value PV1.

The enhancement block 126 may generate the first through N-th display quality enhancement pixel values EPV1, EPV2, . . . , EPVN based on the first through N-th pixel values PV1, PV2, . . . , PVN and outputs of the multiplexer 124. For example, the enhancement block 126 may generate the first display quality enhancement pixel value EPV1 by applying the at least one display quality enhancement algorithm selected based on the first pixel ID PID1 to the first pixel value PV1. The enhancement block 126 may generate the second display quality enhancement pixel value EPV2 by applying the at least one display quality enhancement algorithm selected based on the second pixel ID PID2 to the second pixel value PV2. The enhancement block 126 may generate the N-th display quality enhancement pixel value EPVN by applying the at least one display quality enhancement algorithm selected based on the N-th pixel ID PIDN to the N-th pixel value PVN.

In some example embodiments, an operation of selecting a display quality enhancement algorithm and an operation of generating a display quality enhancement pixel value may be sequentially performed for each of the first through N-th pixel values PV1, PV2, . . . , PVN. For example, an operation of selecting the display quality enhancement algorithm for the first pixel value PV1 based on the first pixel ID PID1 and an operation of generating the first display quality enhancement pixel value EPV1 based on the first pixel value PV1 may be sequentially performed. Subsequently, an operation of selecting the display quality enhancement algorithm for the second pixel value PV2 based on the second pixel ID PID2 and an operation of generating the second display quality enhancement pixel value EPV2 based on the second pixel value PV2 may be sequentially performed. Thereafter, an operation of selecting the display quality enhancement algorithm for the N-th pixel value PVN based on the N-th pixel ID PIDN and an operation of generating the N-th display quality enhancement pixel value EPVN based on the N-th pixel value PVN may be sequentially performed.

In other example embodiments, an operation of selecting a display quality enhancement algorithm may be sequentially performed for all of the first through N-th pixel values PV1, PV2, . . . , PVN, and then an operation of generating a display quality enhancement pixel value may be sequentially performed for all of the first through N-th pixel values PV1, PV2, . . . , PVN. For example, an operation of selecting the display quality enhancement algorithm for the first pixel value PV1 based on the first pixel ID PID1 may be performed, and then an operation of selecting the display quality enhancement algorithm for the second pixel value PV2 based on the second pixel ID PID2 may be performed, and then an operation of selecting the display quality enhancement algorithm for the N-th pixel value PVN based on the N-th pixel ID PIDN may be performed. Thereafter, an operation of generating the first display quality enhancement pixel value EPV1 based on the first pixel value PV1 may be performed, and then an operation of generating the second display quality enhancement pixel value EPV2 based on the second pixel value PV2 may be performed, and then an operation of generating the N-th display quality enhancement pixel value EPVN based on the N-th pixel value PVN may be performed.

FIGS. 3, 4, 5A, 5B, 5C, 5D, 5E, 5F, 5G, 6, 7A, 7B, 7C, 8, 9, 10A and 10B are diagrams for describing an operation of an image processing device according to one or more exemplary embodiments.

Referring to FIG. 3, a display device 200 that displays an image based on the second image data EDAT output from the image processing device 100 may include a plurality of pixels P11, P12, P13, P14, P15, P16, P17, P18, P21, P22, P23, P24, P25, P26, P27, P28, P31, P32, P33, P34, P35, P36, P37, P38, P41, P42, P43, P44, P45, P46, P47, P48, P51, P52, P53, P54, P55, P56, P57, P58, P61, P62, P63, P64, P65, P66, P67, P68, P71, P72, P73, P74, P75, P76, P77, P78, P81, P82, P83, P84, P85, P86, P87, P88, P91, P92, P93, P94, P95, P96, P97, P98, PA1, PA2, PA3, PA4, PA5, PA6, PA7, PA8, PB1, PB2, PB3, PB4, PB5, PB6, PB7, PB8, PC1, PC2, PC3, PC4, PC5, PC6, PC7 and PC8.

Here, each pixel may include a light emitting element (e.g., an organic light emitting diode (OLED)) and at least one transistor for driving the light emitting element.

Although FIG. 3 illustrates that the display device 200 includes 12*8 pixels, example embodiments are not be limited thereto.

Figure 4:
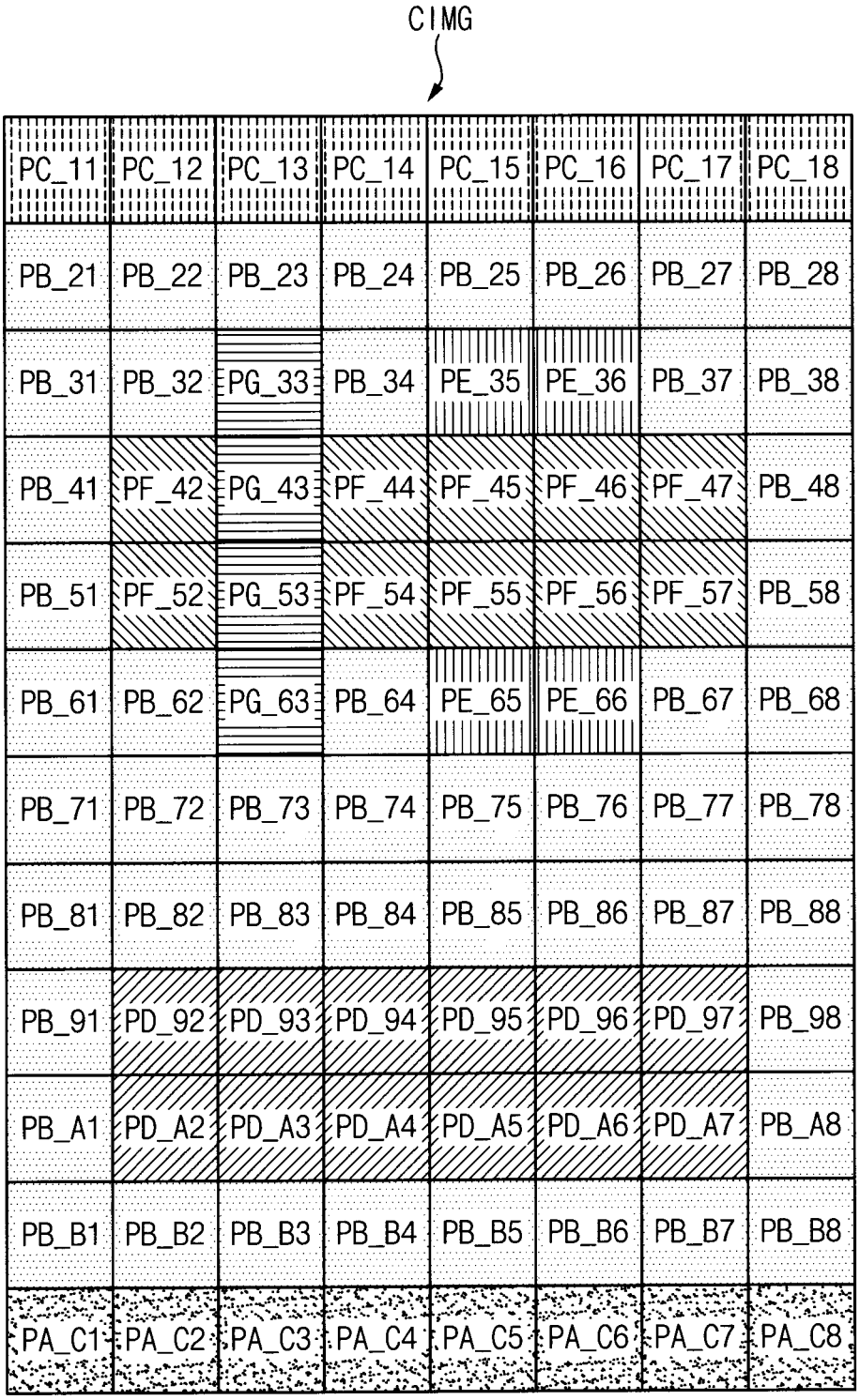

Referring to FIG. 4, one composite image CIMG displayed on the display device 200 of FIG. 3 is illustrated. The composite image CIMG may represent an image entirely displayed on one screen of the display device 200, and may represent an image obtained by synthesizing a plurality of layers (e.g., a plurality of images) which will be described with reference to FIGS. 5A through 5G.

The composite image CIMG may include a plurality of pixel values PC_11, PC_12, PC_13, PC_14, PC_15, PC_16, PC_17, PC_18, PB_21, PB_22, PB_23, PB_24, PB_25, PB_26, PB_27, PB_28, PB_31, PB_32, PG_33, PB_34, PE_35, PE_36, PB_37, PB_38, PB_41, PF_42, PG_43, PF_44, PF_45, PF_46, PF_47, PB_48, PB_51, PF_52, PG_53, PF_54, PF_55, PF_56, PF_57, PB_58, PB_61, PB_62, PG_63, PB_64, PE_65, PE_66, PB_67, PB_68, PB_71, PB_72, PB_73, PB_74, PB_75, PB_76, PB_77, PB_78, PB_81, PB_82, PB_83, PB_84, PB_85, PB_86, PB_87, PB_88, PB_91, PD_92, PD_93, PD_94, PD_95, PD_96, PD_97, PB_98, PB_A1, PD_A2, PD_A3, PD_A4, PD_A5, PD_A6, PD_A7, PB_A8, PB_B1, PB_B2, PB_B3, PB_B4, PB_B5, PB_B6, PB_B7, PB_B8, PA_C1, PA_C2, PA_C3, PA_C4, PA_C5, PA_C6, PA_C7 and PA_C8.

In FIG. 4 and subsequent figures, each pixel value may correspond to each pixel at the same position or location. For example, the pixel value PC_11 in FIG. 4 may correspond to the pixel P11 in FIG. 3, and the pixel P11 may have the pixel value PC_11 and may emit light based on the pixel value PC_11.

Referring to FIGS. 5A, 5B, 5C, 5D, 5E, 5F and 5G, the composite image CIMG of FIG. 4 may be an image obtained by synthesizing first through seventh layers LYA, LYB, LYC, LYD, LYE, LYF and LYG.

Figure 5A:
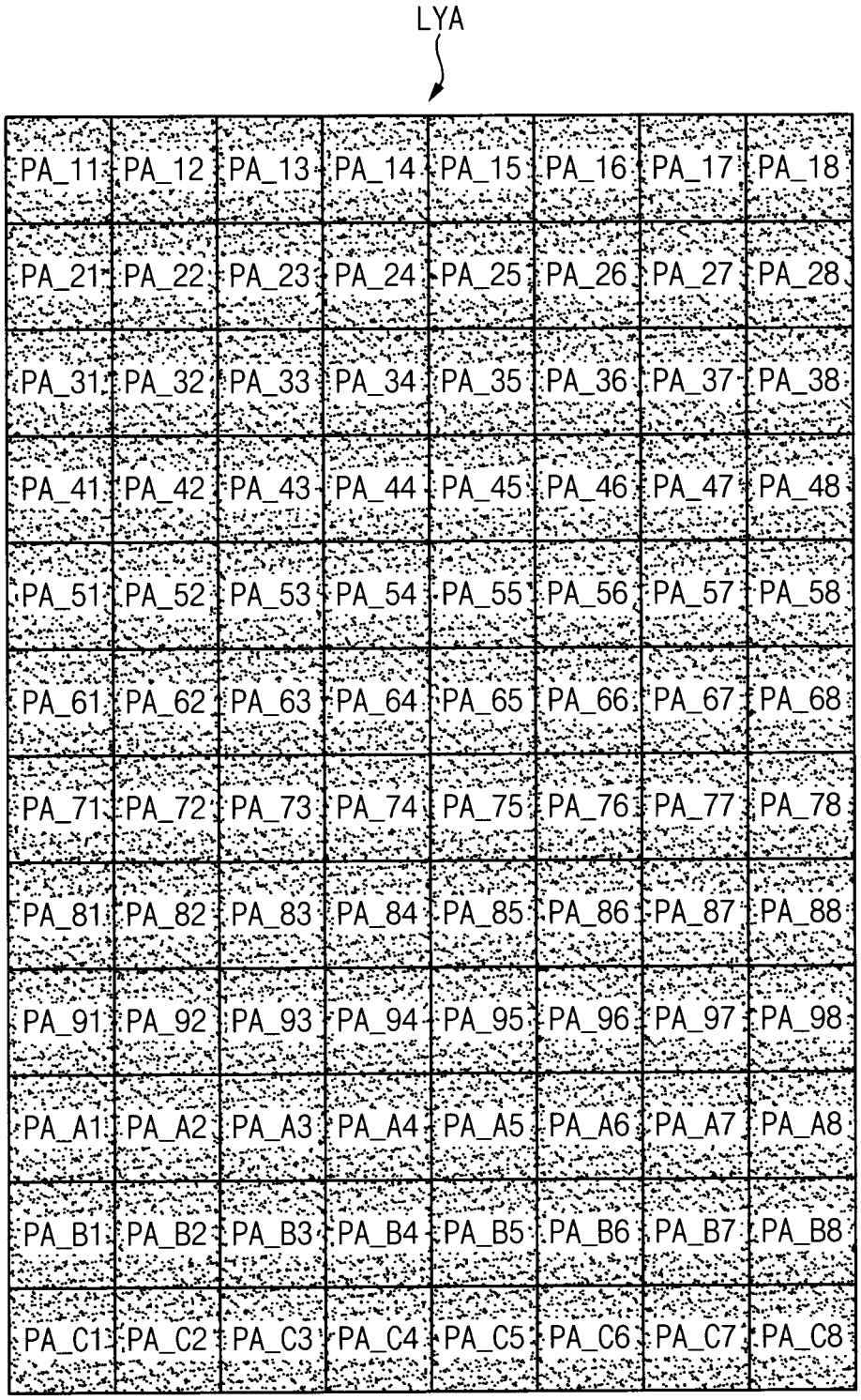

The first layer (e.g., the first image) LYA of FIG. 5A may include a plurality of pixel values PA_11, PA_12, PA_13, PA_14, PA_15, PA_16, PA_17, PA_18, PA_21, PA_22, PA_23, PA_24, PA_25, PA_26, PA_27, PA_28, PA_31, PA_32, PA_33, PA_34, PA_35, PA_36, PA_37, PA_38, PA_41, PA_42, PA_43, PA_44, PA_45, PA_46, PA_47, PA_48, PA_51, PA_52, PA_53, PA_54, PA_55, PA_56, PA_57, PA_58, PA_61, PA_62, PA_63, PA_64, PA_65, PA_66, PA_67, PA_68, PA_71, PA_72, PA_73, PA_74, PA_75, PA_76, PA_77, PA_78, PA_81, PA_82, PA_83, PA_84, PA_85, PA_86, PA_87, PA_88, PA_91, PA_92, PA_93, PA_94, PA_95, PA_96, PA_97, PA_98, PA_A1, PA_A2, PA_A3, PA_A4, PA_A5, PA_A6, PA_A7, PA_A8, PA_B1, PA_B2, PA_B3, PA_B4, PA_B5, PA_B6, PA_B7, PA_B8, PA_C1, PA_C2, PA_C3, PA_C4, PA_C5, PA_C6, PA_C7 and PA_C8.

Figure 5B:
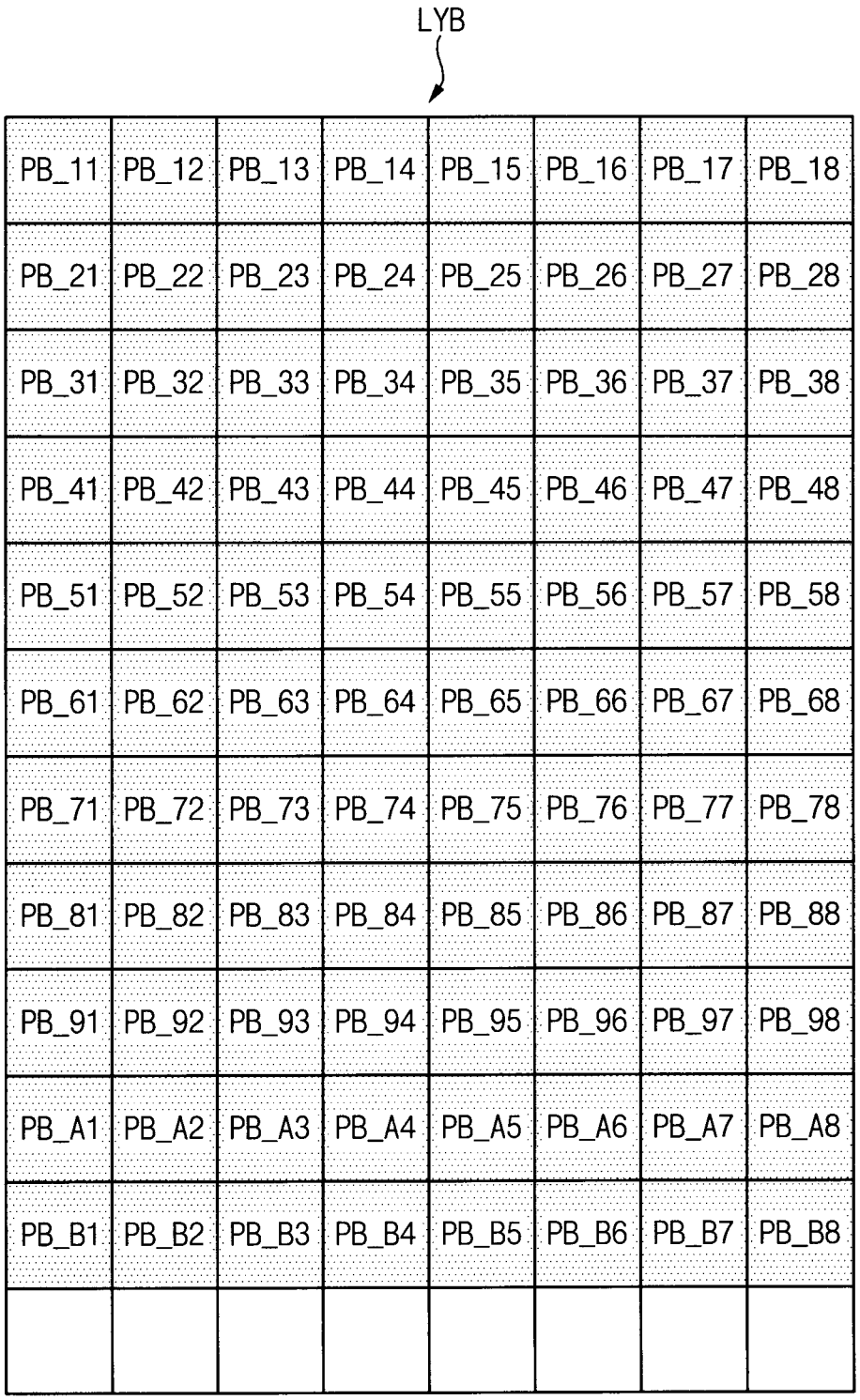

The second layer (e.g., the second image) LYB of FIG. 5B may include a plurality of pixel values PB_11, PB_12, PB_13, PB_14, PB_15, PB_16, PB_17, PB_18, PB_21, PB_22, PB_23, PB_24, PB_25, PB_26, PB_27, PB_28, PB_31, PB_32, PB_33, PB_34, PB_35, PB_36, PB_37, PB_38, PB_41, PB_42, PB_43, PB_44, PB_45, PB_46, PB_47, PB_48, PB_51, PB_52, PB_53, PB_54, PB_55, PB_56, PB_57, PB_58, PB_61, PB_62, PB_63, PB_64, PB_65, PB_66, PB_67, PB_68, PB_71, PB_72, PB_73, PB_74, PB_75, PB_76, PB_77, PB_78, PB_81, PB_82, PB_83, PB_84, PB_85, PB_86, PB_87, PB_88, PB_91, PB_92, PB_93, PB_94, PB_95, PB_96, PB_97, PB_98, PB_A1, PB_A2, PB_A3, PB_A4, PB_A5, PB_A6, PB_A7, PB_A8, PB_B1, PB_B2, PB_B3, PB_B4, PB_B5, PB_B6, PB_B7 and PB_B8.

Figure 5C:
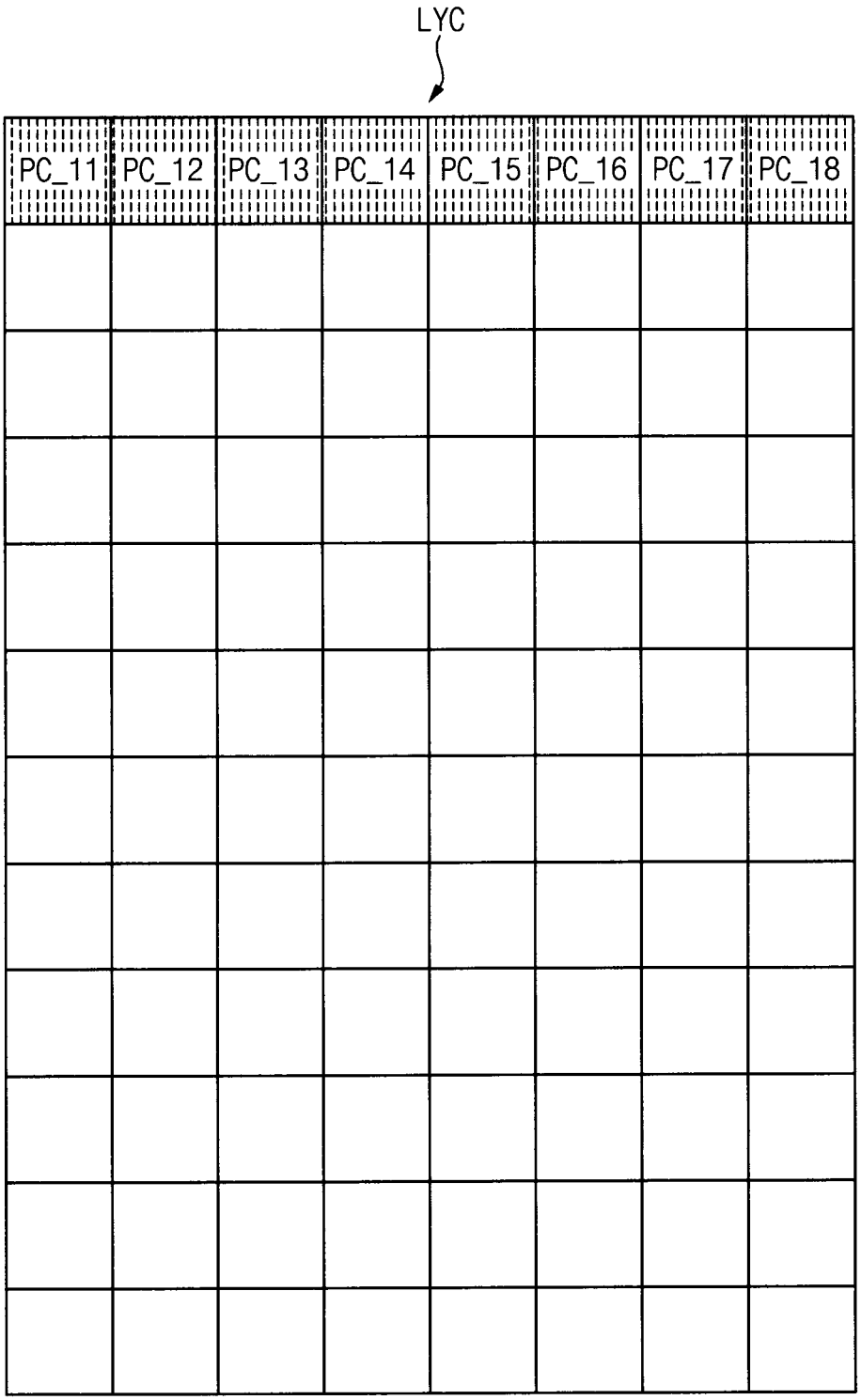

The third layer (e.g., the third image) LYC of FIG. 5C may include a plurality of pixel values PC_11, PC_12, PC_13, PC_14, PC_15, PC_16, PC_17 and PC_18.

Figure 5D:
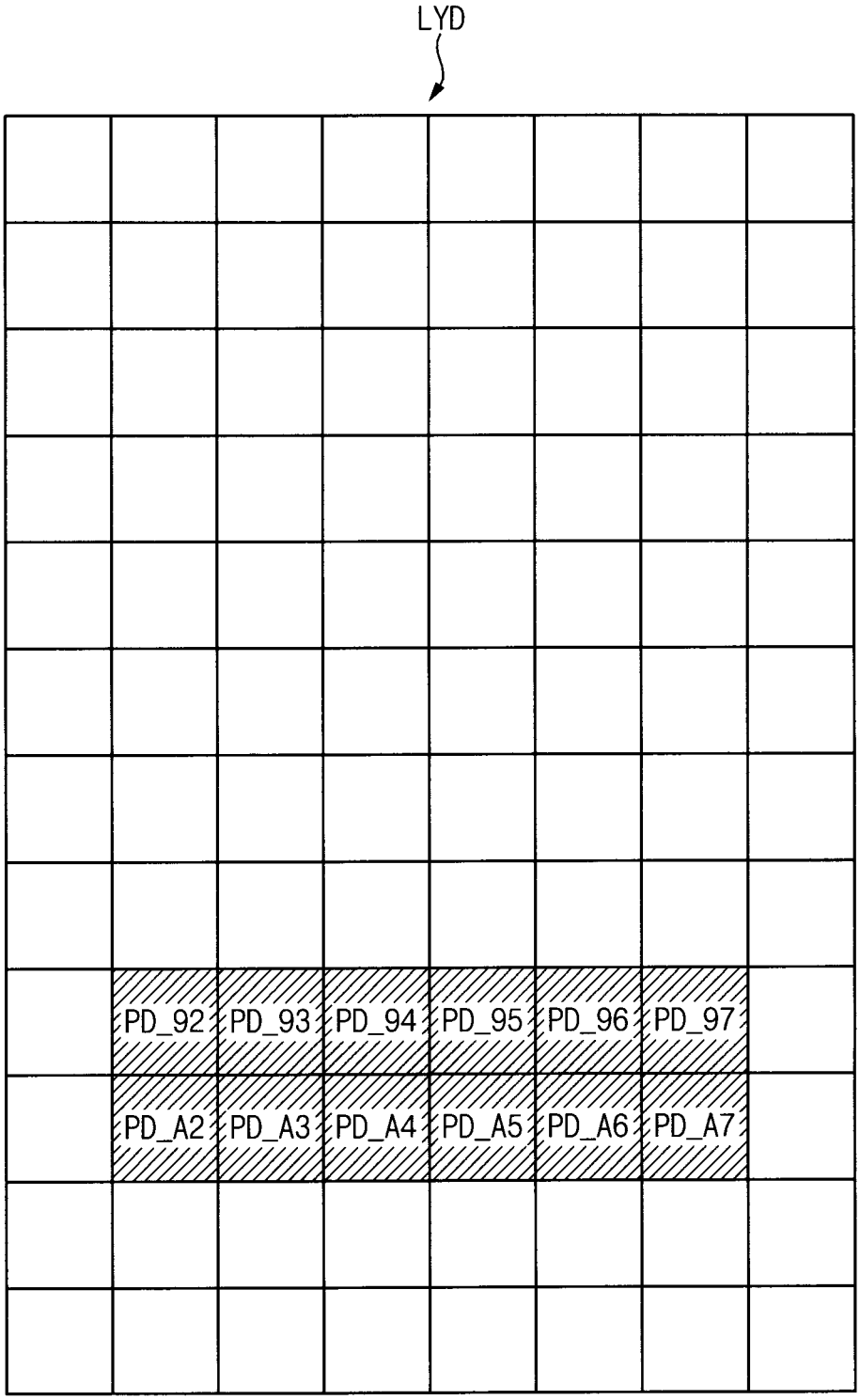

The fourth layer (e.g., the fourth image) LYD of FIG. 5D may include a plurality of pixel values PD_92, PD_93, PD_94, PD_95, PD_96, PD_97, PD_A2, PD_A3, PD_A4, PD_A5, PD_A6 and PD_A7.

Figure 5E:
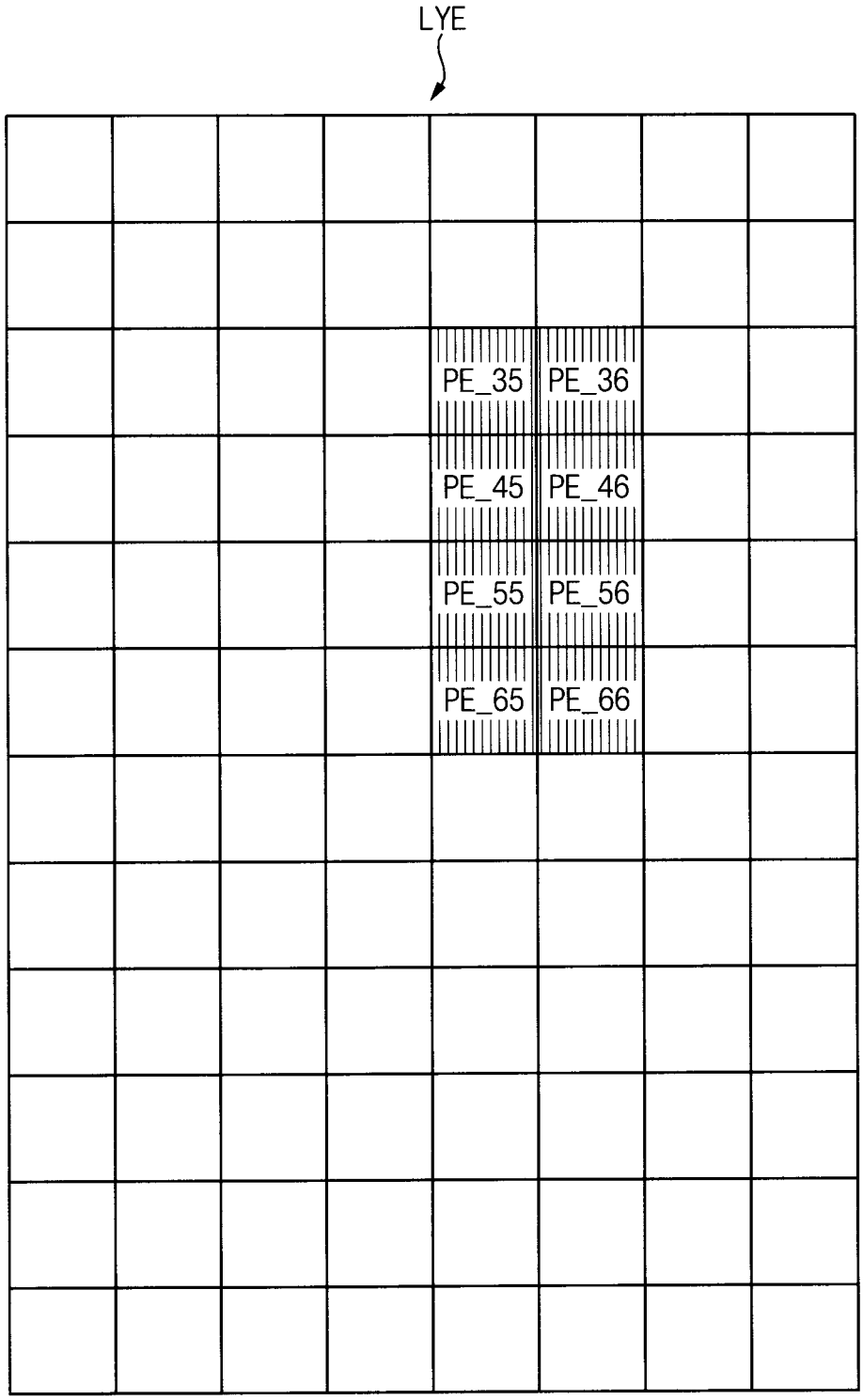

The fifth layer (e.g., the fifth image) LYE of FIG. 5E may include a plurality of pixel values PE_35, PE_36, PE 45, PE 46, PE 55, PE 56, PE_65 and PE_66.

Figure 5F:
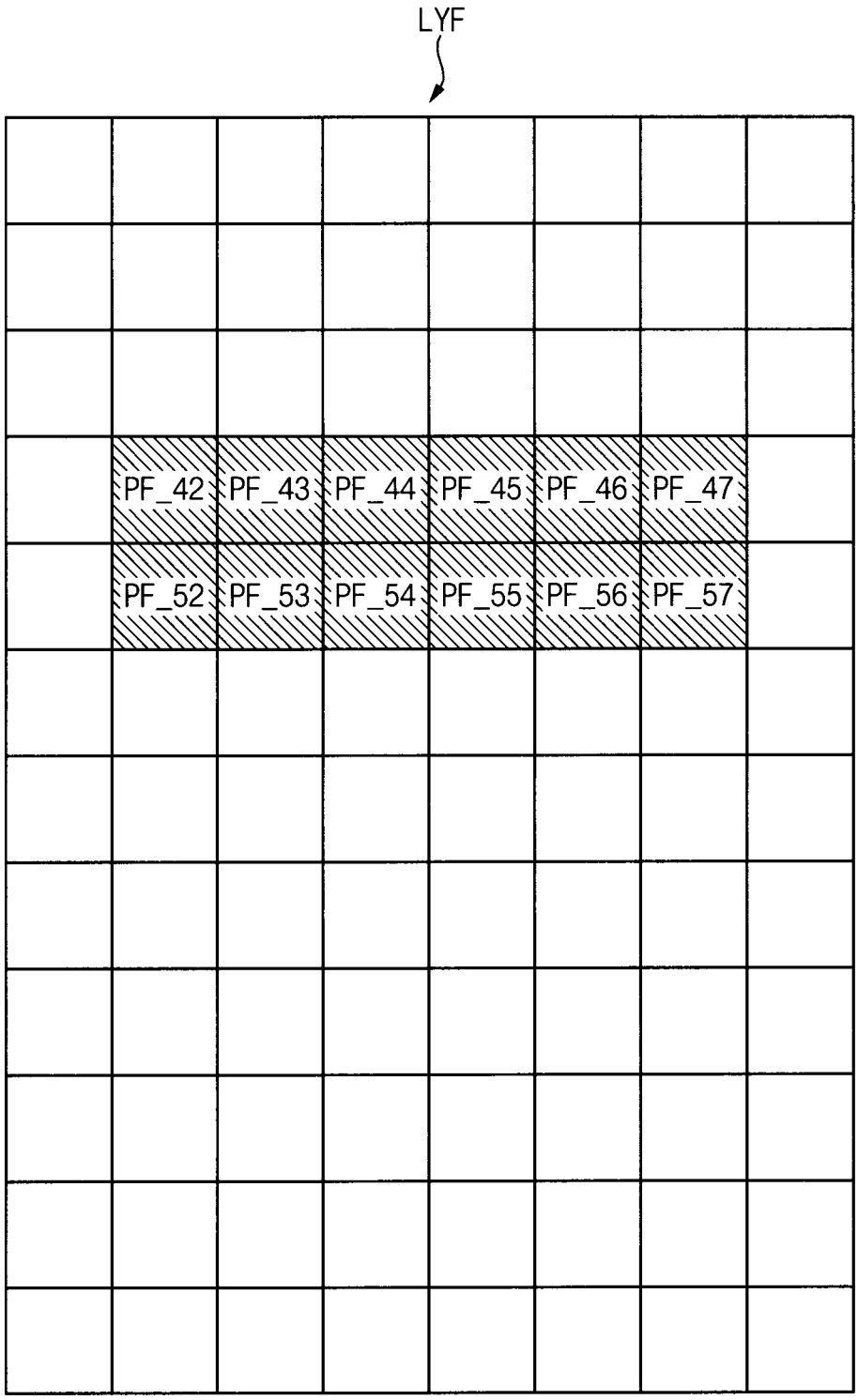

The sixth layer (e.g., the sixth image) LYF of FIG. 5F may include a plurality of pixel values PF_42, PF_43, PF_44, PF_45, PF_46, PF_47, PF_52, PF_53, PF_54, PF_55, PF_56 and PF_57.

Figure 5G:
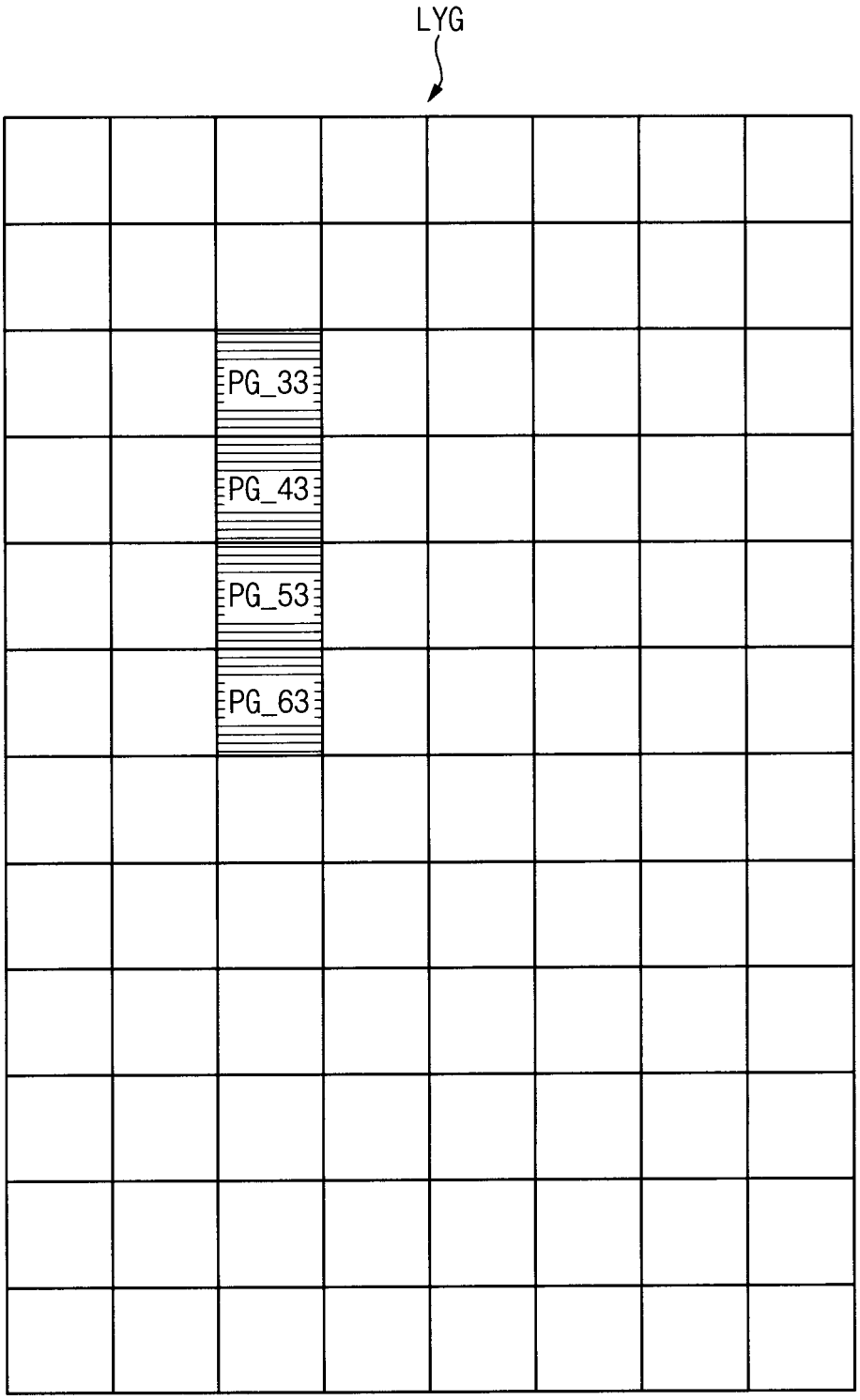

The seventh layer (e.g., the seventh image) LYG of FIG. 5G may include a plurality of pixel values PG_33, PG_43, PG_53 and PG_63.

In some example embodiments, each of the first layer LYA through the seventh layer LYG may represent one application executed by and displayed on an electronic device (or electronic system) including the display device 200. However, example embodiments are not limited thereto.

In FIGS. 5A through 5G, a portion illustrated by a blank space, e.g., a portion in which a pixel value is not included or described, may be a region without a pixel value, e.g., a region in which a corresponding image does not exist.

In the composite image CIMG of FIG. 4, the first layer LYA of FIG. 5A through the seventh layer LYG of FIG. 5G may be sequentially overlapped and disposed. For example, the first layer LYA of FIG. 5A may be disposed at the bottom, the seventh layer LYG of FIG. 5G may be disposed at the top, and only the uppermost layer on each pixel may be displayed. Thus, the composite image CIMG may include only the pixel values PA_C1, PA_C2, PA_C3, PA_C4, PA_C5, PA_C6, PA_C7 and PA_C8 in the first layer LYA (the last row of pixel values shown in FIG. 5A). Similarly, the composite image CIMG may include only the pixel values PB_21, PB_22, PB_23, PB_24, PB_25, PB_26, PB_27, PB_28, PB_31, PB_32, PB_34, PB_37, PB_38, PB_41, PB_48, PB_51, PB_58, PB_61, PB_62, PB_64, PB_67, PB_68, PB_71, PB_72, PB_73, PB_74, PB_75, PB_76, PB_77, PB_78, PB_81, PB_82, PB_83, PB_84, PB_85, PB_86, PB_87, PB_88, PB_91, PB_98, PB_A1, PB_A8, PB_B1, PB_B2, PB_B3, PB_B4, PB_B5, PB_B6, PB_B7 and PB_B8 in the second layer LYB. The composite image CIMG may include only the pixel values PC_11, PC_12, PC_13, PC_14, PC_15, PC_16, PC_17 and PC_18 in the third layer LYC. The composite image CIMG may include only the pixel values PD_92, PD_93, PD_94, PD_95, PD_96, PD_97, PD_A2, PD_A3, PD_A4, PD_A5, PD_A6 and PD_A7 in the fourth layer LYD. The composite image CIMG may include only the pixel values PE_35, PE_36, PE_65 and PE_66 in the fifth layer LYE. The composite image CIMG may include only the pixel values PF_42, PF_44, PF_45, PF_46, PF_47, PF_52, PF_54, PF_55, PF_56 and PF_57 in the sixth layer LYF. The composite image CIMG may include only the pixel values PG_33, PG_43, PG_53 and PG_63 in the seventh layer LYG.

Figure 6:
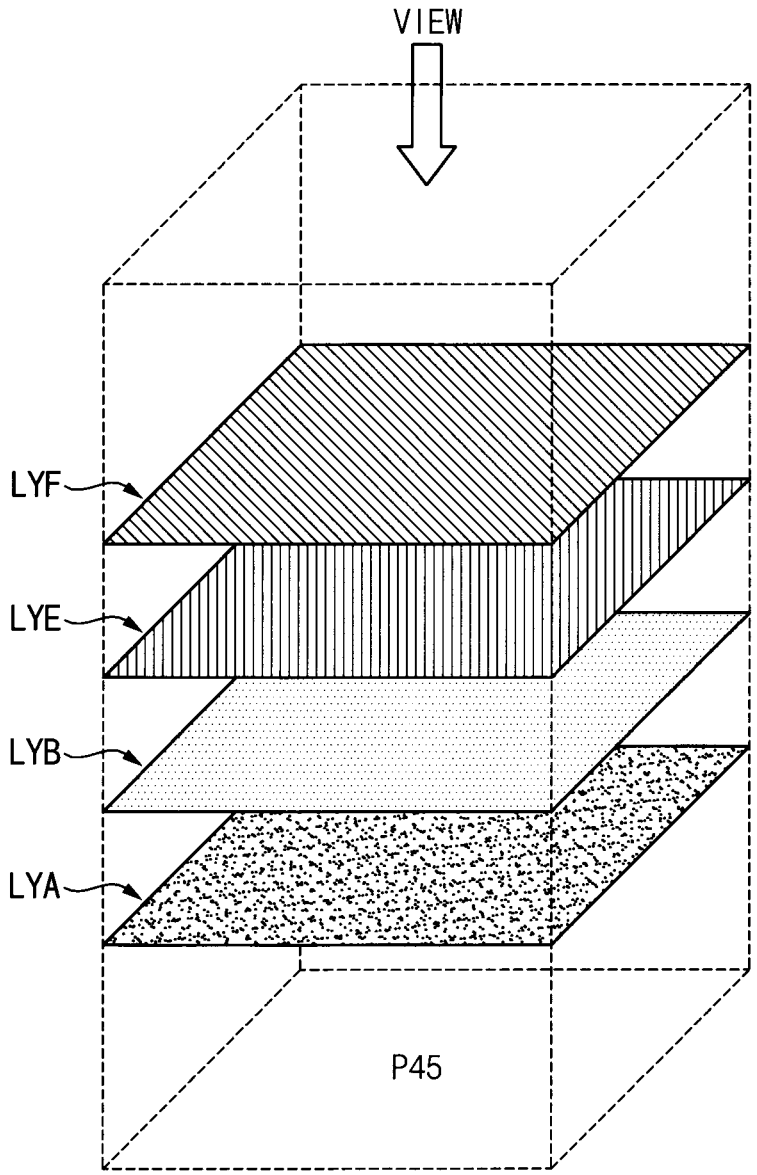

Referring to FIG. 6, an arrangement of the layers on the pixel P45 of the display device 200 of FIG. 3 is illustrated when the composite image CIMG of FIG. 4 is displayed on the display device 200.

For example, the first, second, fifth and sixth layers LYA, LYB, LYE and LYF may be overlapped and disposed on the pixel P45. At least one display quality enhancement algorithm for the pixel P45 may be selected or determined based on one of the first layer LYA, the second layer LYB, the fifth layer LYE and the sixth layer LYF.

In some example embodiments, the sixth layer LYF that is the uppermost layer among the first layer LYA, the second layer LYB, the fifth layer LYE and the sixth layer LYF, may be displayed, and the pixel P45 may have the pixel value PF_45 included in the sixth layer LYF. The at least one display quality enhancement algorithm for the pixel P45 may be selected based on the sixth layer LYF (e.g., based on layer data corresponding to the sixth layer LYF), and a pixel ID corresponding to the selected display quality enhancement algorithm may be generated.

In some example embodiments, the sixth layer LYF may be displayed as semi-transparent, and the fifth layer LYE disposed under the sixth layer LYF may be partially displayed.

Referring to FIG. 7A, a pixel map PMAP generated corresponding to the composite image CIMG of FIG. 4 is illustrated.

The pixel map PMAP may include a plurality of pixel IDs ID_11, ID_12, ID_13, ID_14, ID_15, ID_16, ID_17, ID_18, ID_21, ID_22, ID_23, ID_24, ID_25, ID_26, ID_27, ID_28, ID_31, ID_32, ID_33, ID_34, ID_35, ID_36, ID_37, ID_38, ID_41, ID_42, ID_43, ID_44, ID_45, ID_46, ID_47, ID_48, ID_51, ID_52, ID_53, ID_54, ID_55, ID_56, ID_57, ID_58, ID_61, ID_62, ID_63, ID_64, ID_65, ID_66, ID_67, ID_68, ID_71, ID_72, ID_73, ID_74, ID_75, ID_76, ID_77, ID_78, ID_81, ID_82, ID_83, ID_84, ID_85, ID_86, ID_87, ID_88, ID_91, ID_92, ID_93, ID_94, ID_95, ID_96, ID_97, ID_98, ID_A1, ID_A2, ID_A3, ID_A4, ID_A5, ID_A6, ID_A7, ID_A8, ID_B1, ID_B2, ID_B3, ID_B4, ID_B5, ID_B6, ID_B7, ID_B8, ID_C1, ID_C2, ID_C3, ID_C4, ID_C5, ID_C6, ID_C7 and ID_C8.

In FIG. 7A and subsequent figures, each pixel ID may correspond to each pixel and each pixel value at the same position. For example, the pixel ID ID_11 in FIG. 7A may correspond to the pixel P11 in FIG. 3 and the pixel value PC_11 in FIG. 4.

Referring to FIGS. 7B and 7C, specific examples of the pixel map PMAP of FIG. 7A are illustrated.

In a pixel map PMAP1 of FIG. 7B, all of pixel IDs corresponding to pixel values that are included in the same layer may have the same label or pixel ID. For example, the pixel IDs ID_C1, ID_C2, ID_C3, ID_C4, ID_C5, ID_C6, ID_C7 and ID_C8 corresponding to the pixel values PA_C1, PA_C2, PA_C3, PA_C4, PA_C5, PA_C6, PA_C7 and PA_C8 included in the first layer LYA may have a label of "a." The pixel IDs ID_21, ID_22, ID_23, ID_24, ID_25, ID_26, ID_27, ID_28, ID_31, ID_32, ID_34, ID_37, ID_38, ID_41, ID_48, ID_51, ID_58, ID_61, ID_62, ID_64, ID_67, ID_68, ID_71, ID_72, ID_73, ID_74, ID_75, ID_76, ID_77, ID_78, ID_81, ID_82, ID_83, ID_84, ID_85, ID_86, ID_87, ID_88, ID_91, ID_98, ID_A1, ID_A8, ID_B1, ID_B2, ID_B3, ID_B4, ID_B5, ID_B6, ID_B7 and ID_B8 corresponding to the pixel values PB_21, PB_22, PB_23, PB_24, PB_25, PB_26, PB_27, PB_28, PB_31, PB_32, PB_34, PB_37, PB_38, PB_41, PB_48, PB_51, PB_58, PB_61, PB_62, PB_64, PB_67, PB_68, PB_71, PB_72, PB_73, PB_74, PB_75, PB_76, PB_77, PB_78, PB_81, PB_82, PB_83, PB_84, PB_85, PB_86, PB_87, PB_88, PB_91, PB_98, PB_A1, PB_A8, PB_B1, PB_B2, PB_B3, PB_B4, PB_B5, PB_B6, PB_B7 and PB_B8 included in the second layer LYB may have a label of "b." The pixel IDs ID_11, ID_12, ID_13, ID_14, ID_15, ID_16, ID_17 and ID_18 corresponding to the pixel values PC_11, PC_12, PC_13, PC_14, PC_15, PC_16, PC_17 and PC_18 included in the third layer LYC may have a label of "c." The pixel IDs ID_92, ID_93, ID_94, ID_95, ID_96, ID_97, ID_A2, ID_A3, ID_A4, ID_A5, ID_A6 and ID_A7 corresponding to the pixel values PD_92, PD_93, PD_94, PD_95, PD_96, PD_97, PD_A2, PD_A3, PD_A4, PD_A5, PD_A6 and PD_A7 included in the fourth layer LYD may have a label of "d." The pixel IDs ID_35, ID_36, ID_65 and ID_66 corresponding to the pixel values PE_35, PE_36, PE_65 and PE_66 included in the fifth layer LYE may have a label of "e." The pixel IDs ID_42, ID_44, ID_45, ID_46, ID_47, ID_52, ID_54, ID_55, ID_56 and ID_57 corresponding to the pixel values PF_42, PF_44, PF_45, PF_46, PF_47, PF_52, PF_54, PF_55, PF_56 and PF_57 included in the sixth layer LYF may have a label of "f." The pixel IDs ID_33, ID_43, ID_53 and ID_63 corresponding to the pixel values PG_33, PG_43, PG_53 and PG_63 included in the seventh layer LYG may have a label of "g."

In a pixel map PMAP2 of FIG. 7C, some of pixel IDs corresponding to pixel values included in the same layer may have different labels or pixel IDs. In other words, one layer may not be limited to one pixel ID value. The descriptions already provided above with respect to FIG. 7B will be omitted. For example, among the pixel values included in the fourth layer LYD, the pixel IDs ID_92, ID_93, ID_94, ID_A2, ID_A3 and ID_A4 corresponding to the pixel values PD_92, PD_93, PD_94, PD_A2, PD_A3 and PD_A4 may have a label of "d1," and the pixel IDs ID_95, ID_96, ID_97, ID_A5, ID_A6 and ID_A7 corresponding to the pixel values PD_95, PD_96, PD_97, PD_A5, PD_A6 and PD_A7 may have a label of "d2." Among the pixel values included in the fifth layer LYE, the pixel IDs ID_35 and ID_36 corresponding to the pixel values PE_35 and PE_36 may have a label of "e1," and the pixel IDs ID_65 and ID_66 corresponding to the pixel values PE_65 and PE_66 may have a label of "e2." Among the pixel values included in the sixth layer LYF, the pixel IDs ID_42, ID_44, ID_52 and ID_54 corresponding to the pixel values PF_42, PF_44, PF_52 and PF_54 may have a label of "f1," and the pixel IDs ID_45, ID_46, ID_47, ID_55, ID_56 and ID_57 corresponding to the pixel values PF_45, PF_46, PF_47, PF_55, PF_56 and PF_57 may have a label of "f2." Among the pixel values included in the seventh layer LYG, the pixel IDs ID_33 and ID_43 corresponding to the pixel values PG_33 and PG_43 may have a label of "g1," and the pixel IDs ID_53 and ID_63 corresponding to the pixel values PG_53 and PG_63 may have a label of "g2."

Figure 8:
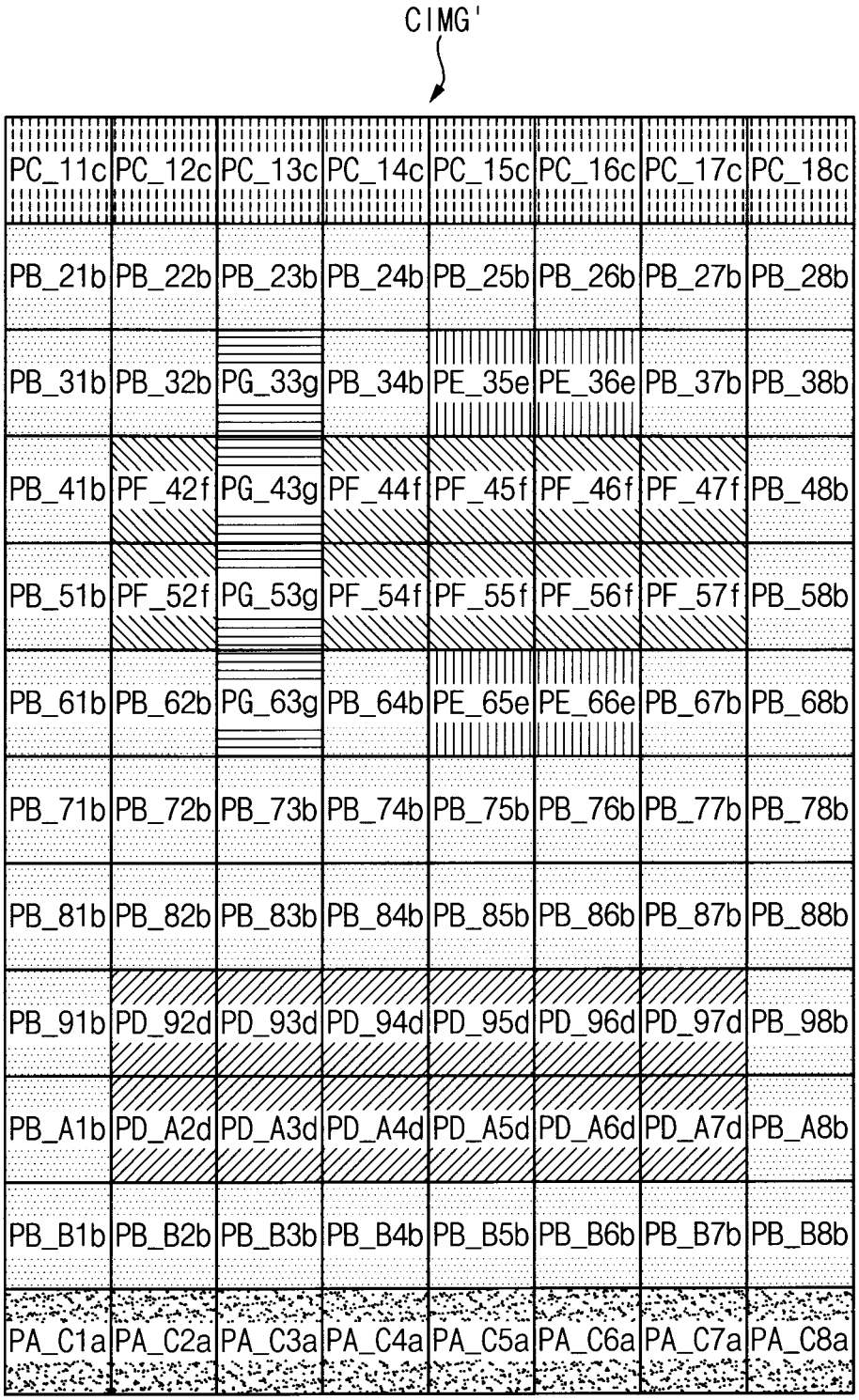

Referring to FIG. 8, a composite image CIMG' generated by applying different optimal display quality enhancement algorithms to the composite image CIMG of FIG. 4 by units of pixels based on the pixel map PMAP1 of FIG. 7B is illustrated. In other words, the composite image CIMG' of FIG. 8 may be an image that is actually displayed on the display device 200 based on the second image data EDAT output from the image processing device 100, and may be an image in which the display quality enhancement is performed by units of pixels.

In the composite image CIMG' of FIG. 8, pixel values PA_C1*a*, PA_C2*a*, PA_C3*a*, PA_C4*a*, PA_C5*a*, PA_C6*a*, PA_C7*a* and PA_C8*a* may be generated by applying at least one display quality enhancement algorithm selected based on the pixel ID having the label of "a." Pixel values PB_21*b*, PB_22*b*, PB_23*b*, PB_24*b*, PB_25*b*, PB_26*b*, PB_27*b*, PB_28*b*, PB_31*b*, PB_32*b*, PB_34*b*, PB_37*b*, PB_38*b*, PB_41*b*, PB_48*b*, PB_51*b*, PB_58*b*, PB_61*b*, PB_62*b*, PB_64*b*, PB_67*b*, PB_68*b*, PB_71*b*, PB_72*b*, PB_73*b*, PB_74*b*, PB_75*b*, PB_76*b*, PB_77*b*, PB_78*b*, PB_81*b*, PB_82*b*, PB_83*b*, PB_84*b*, PB_85*b*, PB_86*b*, PB_87*b*, PB_88*b*, PB_91*b*, PB_98*b*, PB_A1*b*, PB_A8*b*, PB_B1*b*, PB_B2*b*, PB_B3*b*, PB_B4*b*, PB_B5*b*, PB_B6*b*, PB_B7*b* and PB_B8*b* may be generated by applying at least one display quality enhancement algorithm selected based on the pixel ID having the label of "b." Pixel values PC_11*c*, PC_12*c* PC_13*c*, PC_14*c*, PC_15*c*, PC_16*c*, PC_17*c* and PC_18*c* may be generated by applying at least one display quality enhancement algorithm selected based on the pixel ID having the label of "c." Pixel values PD_92*d*, PD_93*d*, PD_94*d*, PD_95*d*, PD_96*d*, PD_97*d*, PD_A2*d*, PD_A3*d*, PD_A4*d*, PD_A5*d*, PD_A6*d* and PD_A7*d* may be generated by applying at least one display quality enhancement algorithm selected based on the pixel ID having the label of "d." Pixel values PE_35*e*, PE_36*e*, PE_65*e* and PE_66*e* may be generated by applying at least one display quality enhancement algorithm selected based on the pixel ID having the label of "e." Pixel values PF_42*f*, PF_44*f*, PF_45*f*, PF_46*f*, PF_47*f*, PF_52*f*, PF_54*f*, PF_55*f*, PF_56*f* and PF_57*f* may be generated by applying at least one display quality enhancement algorithm selected based on the pixel ID having the label of "f" Pixel values PG_33*g*, PG_43*g*, PG_53*g* and PG_63*g* may be generated by applying at least one display quality enhancement algorithm selected based on the pixel ID having the label of "g."

Referring to FIG. 9, a pixel map PMAP' generated corresponding to the composite image CIMG of FIG. 4 is illustrated. FIG. 9 illustrates an example where pixel IDs are generated for only some pixel values.

The pixel map PMAP' may include a plurality of pixel IDs ID_33, ID_35, ID_36, ID_42, ID_43, ID_44, ID_45, ID_46, ID_47, ID_52, ID_53, ID_54, ID_55, ID_56, ID_57, ID_63, ID_65, ID_66, ID_92, ID_93, ID_94, ID_95, ID_96, ID_97, ID_A2, ID_A3, ID_A4, ID_A5, ID_A6 and ID_A7. In FIG. 9, a portion illustrated by a blank space, e.g., a portion in which a pixel ID is not included or described, may be a region in which a pixel ID is not generated.

In some example embodiments, the display quality enhancement algorithms may be applied only to pixel values for which pixel IDs are generated. For example, when the display quality enhancement algorithms are applied to the composite image CIMG of FIG. 4 based on the pixel map PMAP' of FIG. 9, different optimal display quality enhancement algorithms may be applied only to the pixel values PG_33, PE_35, PE_36, PF_42, PG_43, PF_44, PF_45, PF_46, PF_47, PF_52, PG_53, PF_54, PF_55, PF_56, PF_57, PG_63, PE_65, PE_66, PD_92, PD_93, PD_94, PD_95, PD_96, PD_97, PD_A2, PD_A3, PD_A4, PD_A5, PD_A6 and PD_A7 in the composite image CIMG by units of pixels. The display quality enhancement algorithms may not be applied to the pixel values PC_11, PC_12, PC_13, PC_14, PC_15, PC_16, PC_17, PC_18, PB_21, PB_22, PB_23, PB_24, PB_25, PB_26, PB_27, PB_28, PB_31, PB_32, PB_34, PB_37, PB_38, PB_41, PB_48, PB_51, PB_58, PB_61, PB_62, PB_64, PB_67, PB_68, PB_71, PB_72, PB_73, PB_74, PB_75, PB_76, PB_77, PB_78, PB_81, PB_82, PB_83, PB_84, PB_85, PB_86, PB_87, PB_88, PB_91, PB_98, PB_A1, PB_A8, PB_B1, PB_B2, PB_B3, PB_B4, PB_B5, PB_B6, PB_B7, PB_B8, PA_C1, PA_C2, PA_C3, PA_C4, PA_C5, PA_C6, PA_C7 and PA_C8.

In other example embodiments, to pixel values for which pixel IDs are generated, the display quality enhancement algorithms may be applied based on current pixel IDs. To pixel values for which pixel IDs are not generated, the display quality enhancement algorithms may be applied based on previous pixel IDs stored in a memory. For example, when the display quality enhancement algorithms are applied to the composite image CIMG of FIG. 4 based on the pixel map PMAP' of FIG. 9, the different optimal display quality enhancement algorithms may be applied, based on the pixel IDs included in the pixel map PMAP', to the pixel values PG_33, PE_35, PE_36, PF_42, PG_43, PF_44, PF_45, PF_46, PF_47, PF_52, PG_53, PF_54, PF_55, PF_56, PF_57, PG_63, PE_65, PE_66, PD_92, PD_93, PD_94, PD_95, PD_96, PD_97, PD_A2, PD_A3, PD_A4, PD_A5, PD_A6 and PD_A7 in the composite image CIMG by units of pixels. In addition, the different optimal display quality enhancement algorithms may be applied, based on the pixel IDs included in the pixel map that is previously generated (e.g., the pixel map PMAP of FIG. 7A), to the pixel values PC_11, PC_12, PC_13, PC_14, PC_15, PC_16, PC_17, PC_18, PB_21, PB_22, PB_23, PB_24, PB_25, PB_26, PB_27, PB_28, PB_31, PB_32, PB_34, PB_37, PB_38, PB_41, PB_48, PB_51, PB_58, PB_61, PB_62, PB_64, PB_67, PB_68, PB_71, PB_72, PB_73, PB_74, PB_75, PB_76, PB_77, PB_78, PB_81, PB_82, PB_83, PB_84, PB_85, PB_86, PB_87, PB_88, PB_91, PB_98, PB_A1, PB_A8, PB_B1, PB_B2, PB_B3, PB_B4, PB_B5, PB_B6, PB_B7, PB_B8, PA_C1, PA_C2, PA_C3, PA_C4, PA_C5, PA_C6, PA_C7 and PA_C8 in the composite image CIMG by units of pixels.

Figure 10A:
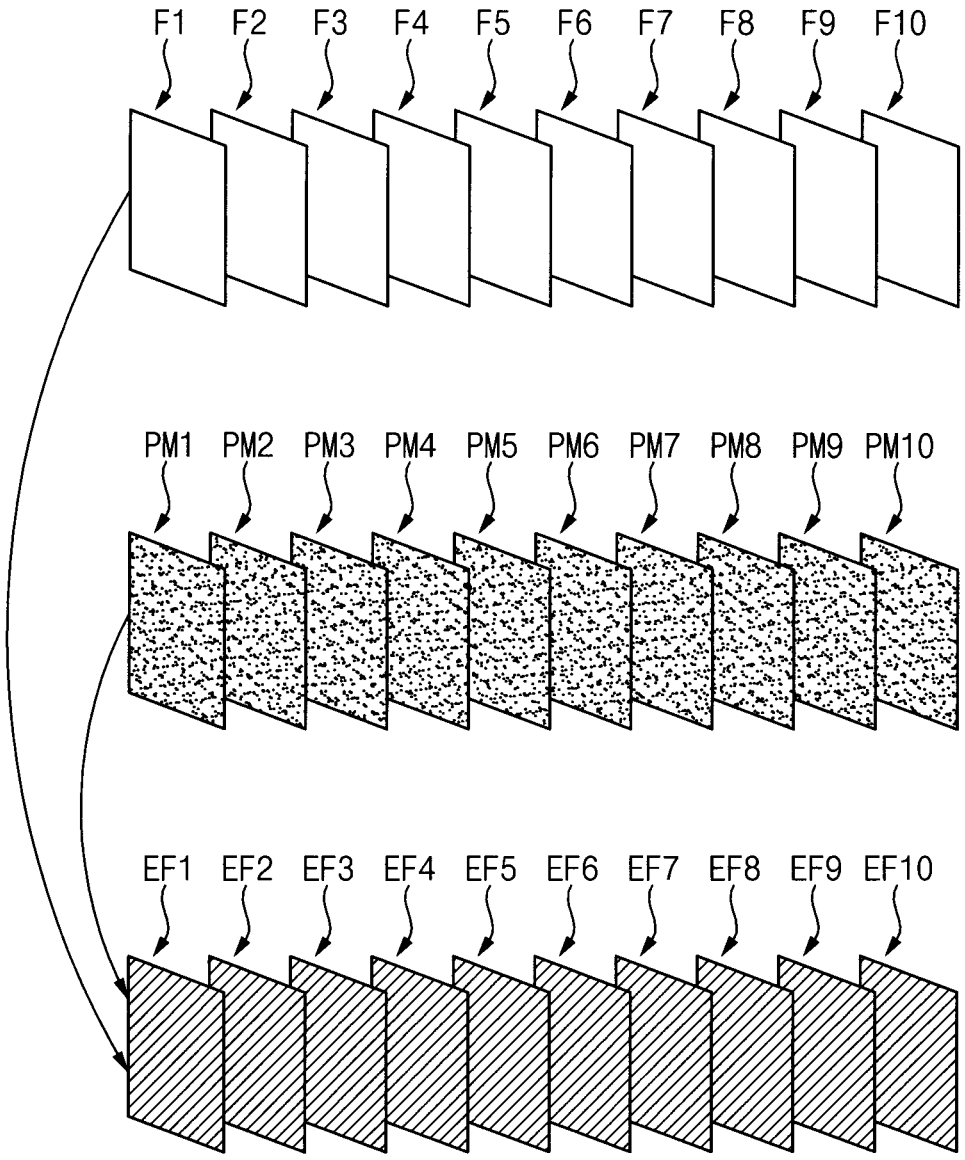
Figure 10B:
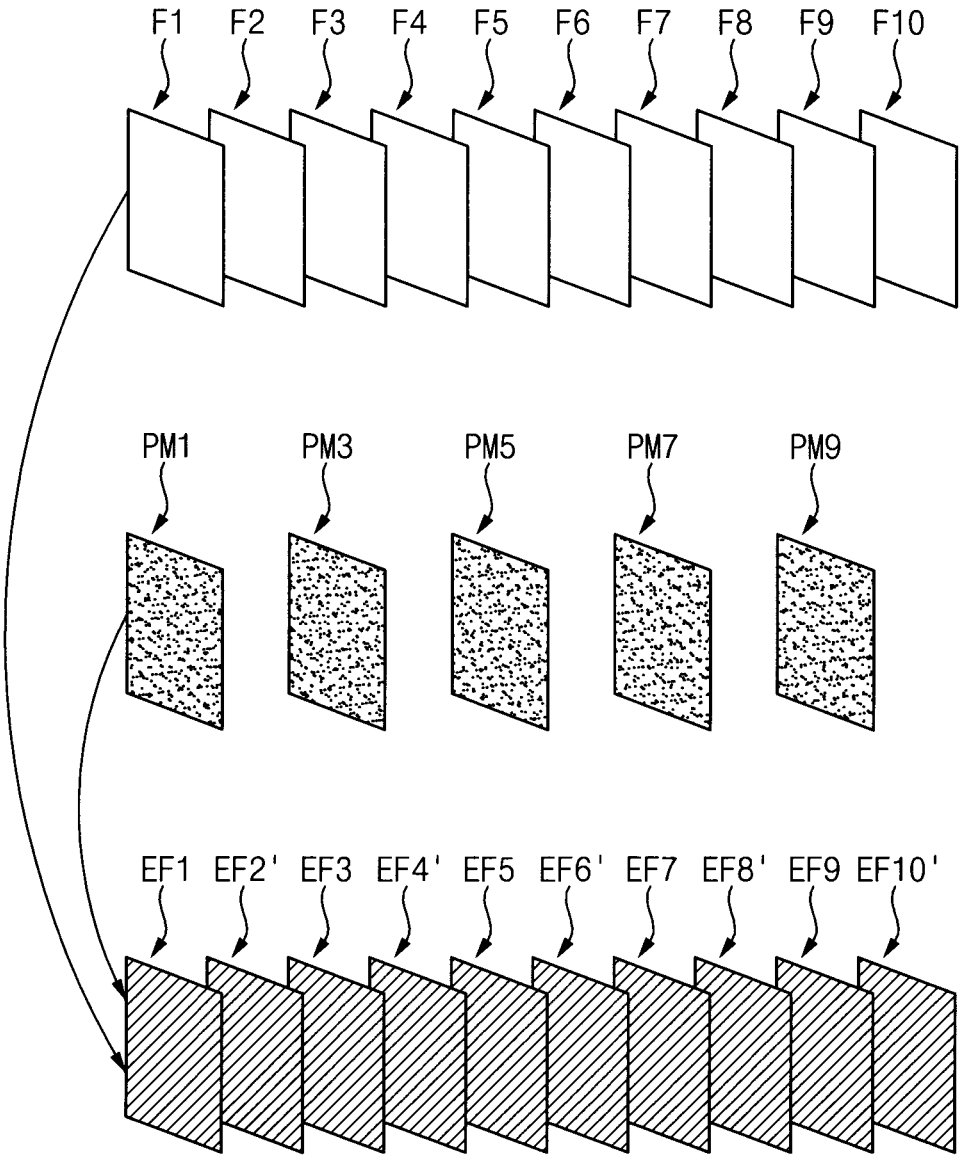

FIGS. 10A and 10B illustrate examples in which a plurality of frame images displayed on the display device 200 are sequentially generated based on the first image data IDAT, the pixel map data PMDAT and the second image data EDAT.

In FIGS. 10A and 10B, each of frame images F1, F2, F3, F4, F5, F6, F7, F8, F9 and F10 may correspond to the composite image displayed based on the first image data IDAT, each of pixel maps PM1, PM2, PM3, PM4, PM5, PM6, PM7, PM8, PM9 and PM10 may correspond to the pixel map data PMDAT, and each of display quality enhancement frame images EF1, EF2, EF2', EF3, EF4, EF4', EF5, EF6, EF6', EF7, EF8, EF8', EF9, EF10 and EF10' may correspond to the composite image having enhanced display quality and displayed based on the second image data EDAT.

In an example of FIG. 10A, the first image data IDAT and the pixel map data PMDAT may be generated for each frame of a plurality of frames, and the second image data EDAT may be generated for each frame based on the first image data IDAT and the pixel map data PMDAT. For example, in a first frame, the first frame image F1 and the first pixel map PM1 may be generated, and the first display quality enhancement frame image EF1 may be generated based on the first frame image F1 and the first pixel map PM1. In a second frame subsequent to the first frame, the second frame image F2 and the second pixel map PM2 may be generated, and the second display quality enhancement frame image EF2 may be generated based on the second frame image F2 and the second pixel map PM2.

In an example of FIG. 10B, the first image data IDAT may be generated for each frame, the pixel map data PMDAT may be generated for X frames (or every X frames), where X is a natural number greater than or equal to two, and the second image data EDAT may be generated for each frame based on the first image data IDAT and the pixel map data PMDAT. FIG. 10B illustrates an example where X=2. For example, in a first frame, the first frame image F1 and the first pixel map PM1 may be generated, and the first display quality enhancement frame image EF1 may be generated based on the first frame image F1 and the first pixel map PM1. In a second frame subsequent to the first frame, the second frame image F2 may be generated, the second pixel map PM2 may not be generated, and the second display quality enhancement frame image EF2' may be generated based on the second frame image F2 that is currently generated and the first pixel map PM1 that is previously generated.

Although FIG. 10B illustrates an example where the pixel map is uniformly generated for every odd-numbered frame, example embodiments are not limited thereto, and the pixel map may be generated uniformly or irregularly for frames of an arbitrary interval. Moreover, the pixel map PMAP including the pixel IDs corresponding to all pixel values may be generated for some frames (e.g., for odd-numbered frames) as described with reference to FIG. 7A, and the pixel map PMAP' including only the pixel IDs corresponding to some pixel values may be generated for the other frames (e.g., for even-numbered frames) as described with reference to FIG. 9.

Although exemplary embodiments are described based on a specific number of pixels, layers, pixel values, pixel IDs and frames, the one or more embodiments are not limited thereto.

Figure 11:
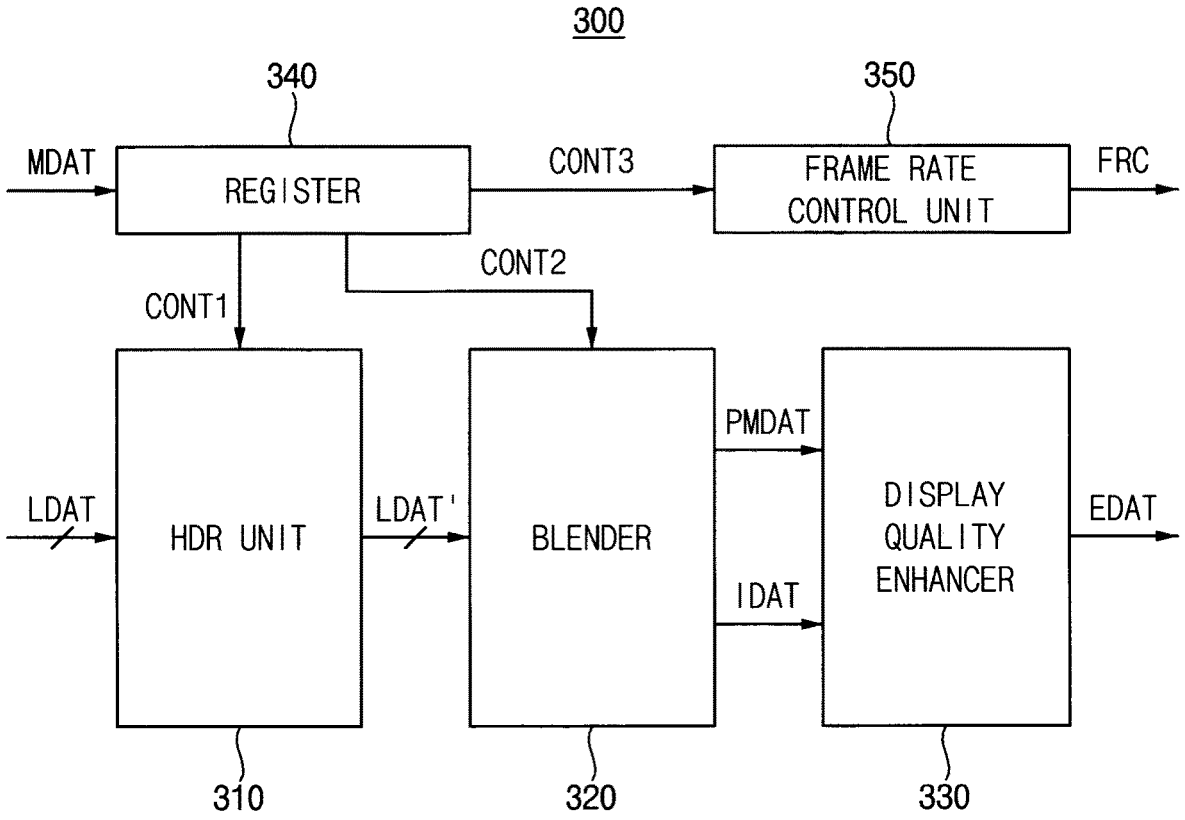
FIG. 11 is a block diagram illustrating a display controller including an image processing device according to an exemplary embodiment.

FIG. 11 is a block diagram illustrating a display controller including an image processing device according to an exemplary embodiment. The descriptions already provided above with respect to FIG. 1 will not be repeated.

Referring to FIG. 11, a display controller 300 includes a blender 320 and a display quality enhancer 330. The display controller 300 may further include a high dynamic range (HDR) unit 310, a register 340 and a frame rate control unit 350. The display controller 300 may be referred to as a display processing unit (DPU).

The HDR unit 310 receives a plurality of layer data LDAT, and performs a HDR processing on the plurality of layer data LDAT based on a first control signal CONT1 from the register 340. The plurality of layer data LDAT may be substantially the same as the plurality of layer data LDAT described with reference to FIG. 1. As compared with the plurality of images corresponding to the plurality of layer data LDAT, a plurality of images corresponding to a plurality of layer data LDAT' that are output from the HDR unit 310 and on which the HDR processing is performed, may include HDR images having an extended dynamic range. As will be described later, the first control signal CONT1 may be generated based on at least one meta data MDAT input to the register 340, and thus the HDR unit 310 may generate the plurality of layer data LDAT' on which the HDR processing is performed based on the at least one meta data MDAT.

The blender 320 generates first image data IDAT and pixel map data PMDAT based on a second control signal CONT2 from the register 340 and the plurality of layer data LDAT' that are output from the HDR unit 310 and on which the HDR processing is performed. The display quality enhancer 330 generates second image data EDAT based on the first image data IDAT and the pixel map data PMDAT output from the blender 320. As will be described later, the second control signal CONT2 may be generated based on the at least one meta data MDAT by the register 340, and thus, the blender 320 may generate the first image data IDAT and the pixel map data PMDAT based on the at least one meta data MDAT.

The blender 320 and the display quality enhancer 330 may be substantially the same as the blender 110 and the display quality enhancer 120 of FIG. 1, respectively. For example, the blender 320 and the display quality enhancer 330 may have the configurations illustrated in FIG. 2, and may perform the operations described with reference to FIGS. 3 through 10.

In some example embodiments, the display controller 300 including the blender 320 and the display quality enhancer 330 may be described as including the image processing device 100 according to example embodiments, and/or the display controller 300 including the HDR unit 310, the blender 320, the display quality enhancer 330, the register 340 and the frame rate control unit 350 may be described as the image processing device according to example embodiments.

The register 340 receives the at least one meta data MDAT corresponding to at least one of the plurality of layer data LDAT, and generates the first control signal CONT1, the second control signal CONT2 and a third control signal CONT3 based on the at least one meta data MDAT. For example, the register 340 may include at least one setting register.

The frame rate control unit 350 generates a frame rate control signal FRC for controlling a frame rate of a display device based on the third control signal CONT3 that is generated based on the at least one metadata MDAT. For example, the frame control unit 350 may generate an FRC for adjusting a frame rate of a display device.

Figure 12:
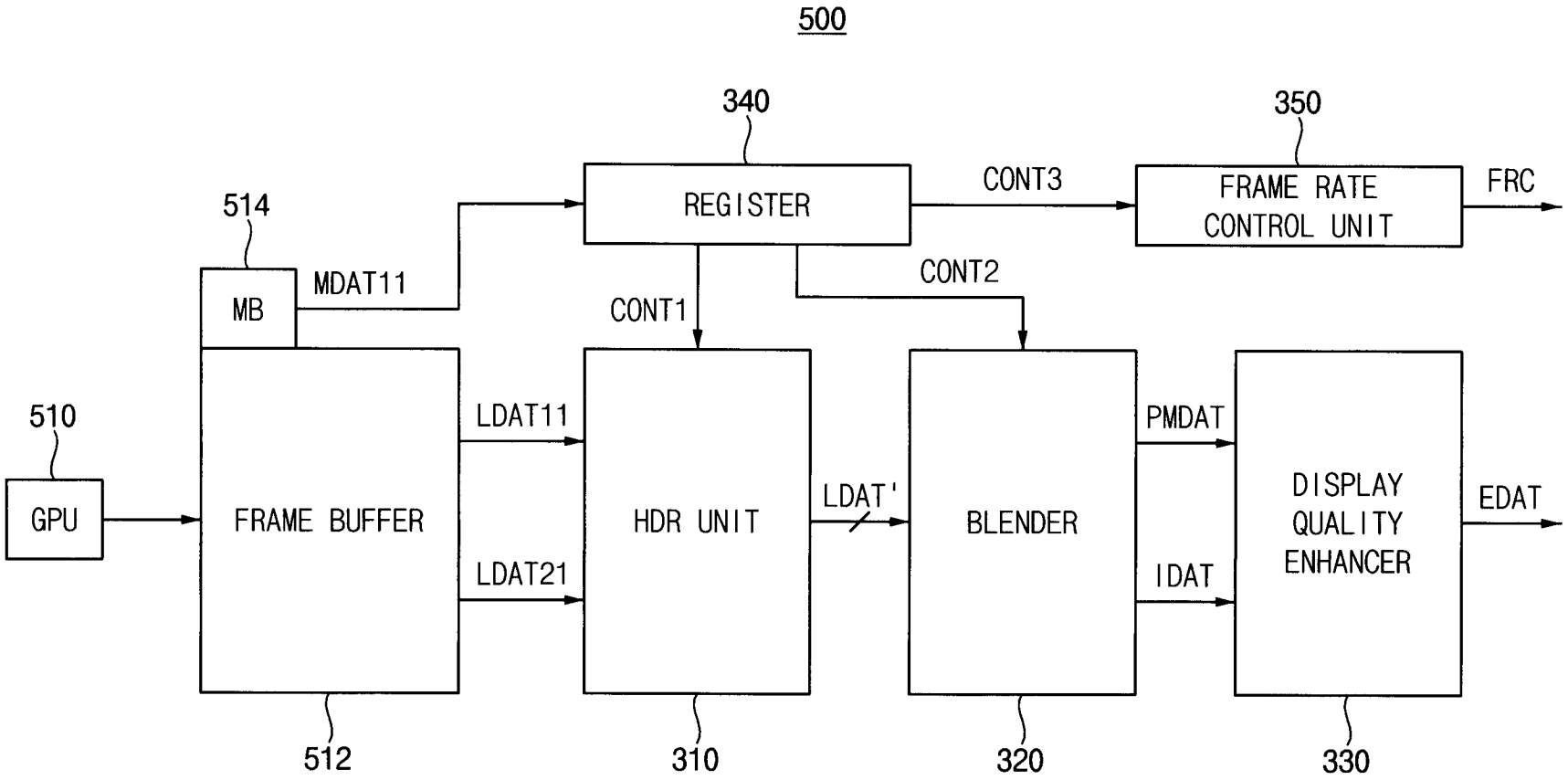
FIGS. 12 and 13 are block diagrams illustrating an application processor including an image processing device according to exemplary embodiments.
Figure 13:
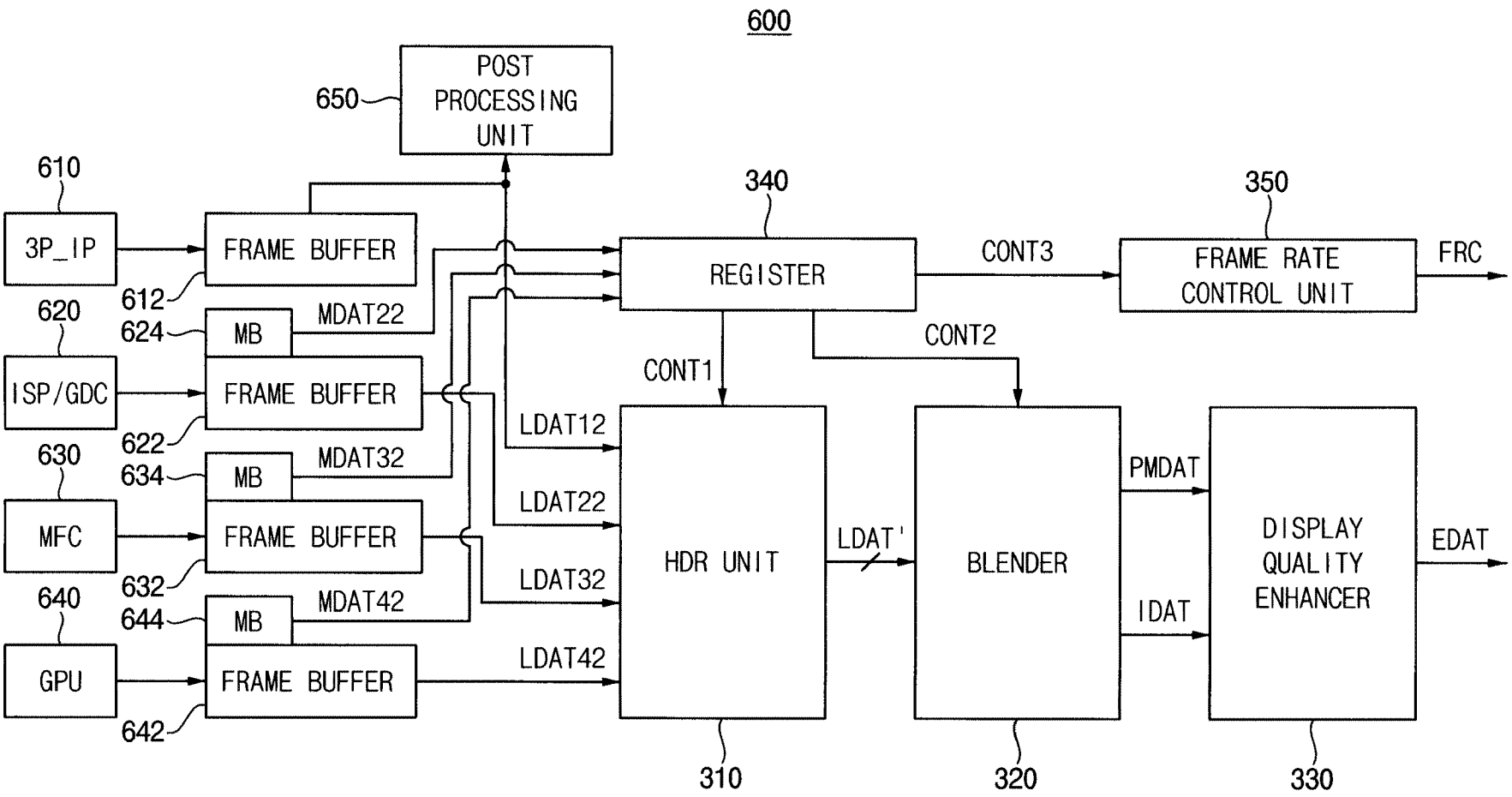

FIGS. 12 and 13 are block diagrams illustrating an application processor including an image processing device according to exemplary embodiments. The descriptions provided above with respect to FIGS. 1 and 11 will not be repeated.

Referring to FIG. 12, an application processor 500 includes a processor (e.g., an intellectual property (IP) or a graphic processing unit) 510, a frame buffer 512, a meta data buffer (MB) 514, a HDR unit 310, a blender 320, a display quality enhancer 330, a register 340 and a frame rate control unit 350.

The processor 510 provides layer data LDAT11 and LDAT21 and meta data MDAT11 corresponding the layer data LDAT11 and LDAT21. For example, the processor 510 may include a graphic processing unit (GPU).

The frame buffer 512 stores and outputs the layer data LDAT11 and LDAT21, and the meta data buffer 514 stores and outputs the meta data MDAT11. For example, each of the frame buffer 512 and the meta data buffer 514 may correspond to a partial region of one memory device.

In an example of FIG. 12, the layer data LDAT11 and LDAT21 may be provided from one processor (or one data processing device) 510.

The HDR unit 310, the blender 320, the display quality enhancer 330, the register 340 and the frame rate control unit 350 may be substantially the same as the HDR unit 310, the blender 320, the display quality enhancer 330, the register 340 and the frame rate control unit 350 in FIG. 11, respectively. The HDR unit 310 performs the HDR processing on the layer data LDAT11 and LDAT21, and the register 340 generates the control signals CONT1, CONT2 and CONT3 based on the meta data MDAT11.

Referring to FIG. 13, an application processor 600 includes a plurality of processors (or IPs) 610, 620, 630 and 640, frame buffers 612, 622, 632 and 642, meta data buffers 624, 634 and 644, a post-processing unit 650, a HDR unit 310, a blender 320, a display quality enhancer 330, a register 340 and a frame rate control unit 350.

The processor 610 provides layer data LDAT12, the processor 620 provides layer data LDAT22 and meta data MDAT22 corresponding the layer data LDAT22, the processor 630 provides layer data LDAT32 and meta data MDAT32 corresponding the layer data LDAT32, and the processor 640 provides layer data LDAT42 and meta data MDAT42 corresponding the layer data LDAT42. For example, the processor 610 may include a third party IP, the processor 620 may include an image signal processor (ISP) and/or a graphic display controller (GDC), the processor 630 may include a multi format codec (MFC), and the processor 640 may include a GPU. For example, the third party IP may not provide meta data.

The frame buffer 612 stores and outputs the layer data LDAT12, the frame buffer 622 stores and outputs the layer data LDAT22, the frame buffer 632 stores and outputs the layer data LDAT32, and the frame buffer 642 stores and outputs the layer data LDAT42. The meta data buffer 624 stores and outputs the meta data MDAT22, the meta data buffer 634 stores and outputs the meta data MDAT32, and the meta data buffer 644 stores and outputs the meta data MDAT42.

The post-processing unit 650 may perform a post-processing on the layer data LDAT12 and provide the post-processed layer data LDAT12. For example, the post-processing unit 650 may include at least one of a GPU, a central processing unit (CPU), a digital signal processor (DSP) and a neural processing unit (NPU), and/or may include various other data processing devices. When the layer data LDAT12 is post-processed, the post-processing unit 650 may provide the post-processed layer data LDAT12 and meta data corresponding the post-processed layer data LDAT12 together.

In an example of FIG. 13, the layer data LDAT12, LDAT22, LDAT32 and LDAT42 may be provided from two or more processors (or two or more data processing devices) 610, 620, 630 and 640.

The HDR unit 310, the blender 320, the display quality enhancer 330, the register 340 and the frame rate control unit 350 may be substantially the same as the HDR unit 310, the blender 320, the display quality enhancer 330, the register 340 and the frame rate control unit 350 in FIG. 11, respectively. The HDR unit 310 performs the HDR processing on the layer data LDAT12, LDAT22, LDAT32 and LDAT42, and the register 340 generates the control signals CONT1, CONT2 and CONT3 based on the meta data MDAT22, MDAT32 and MDAT42.

Figure 14:
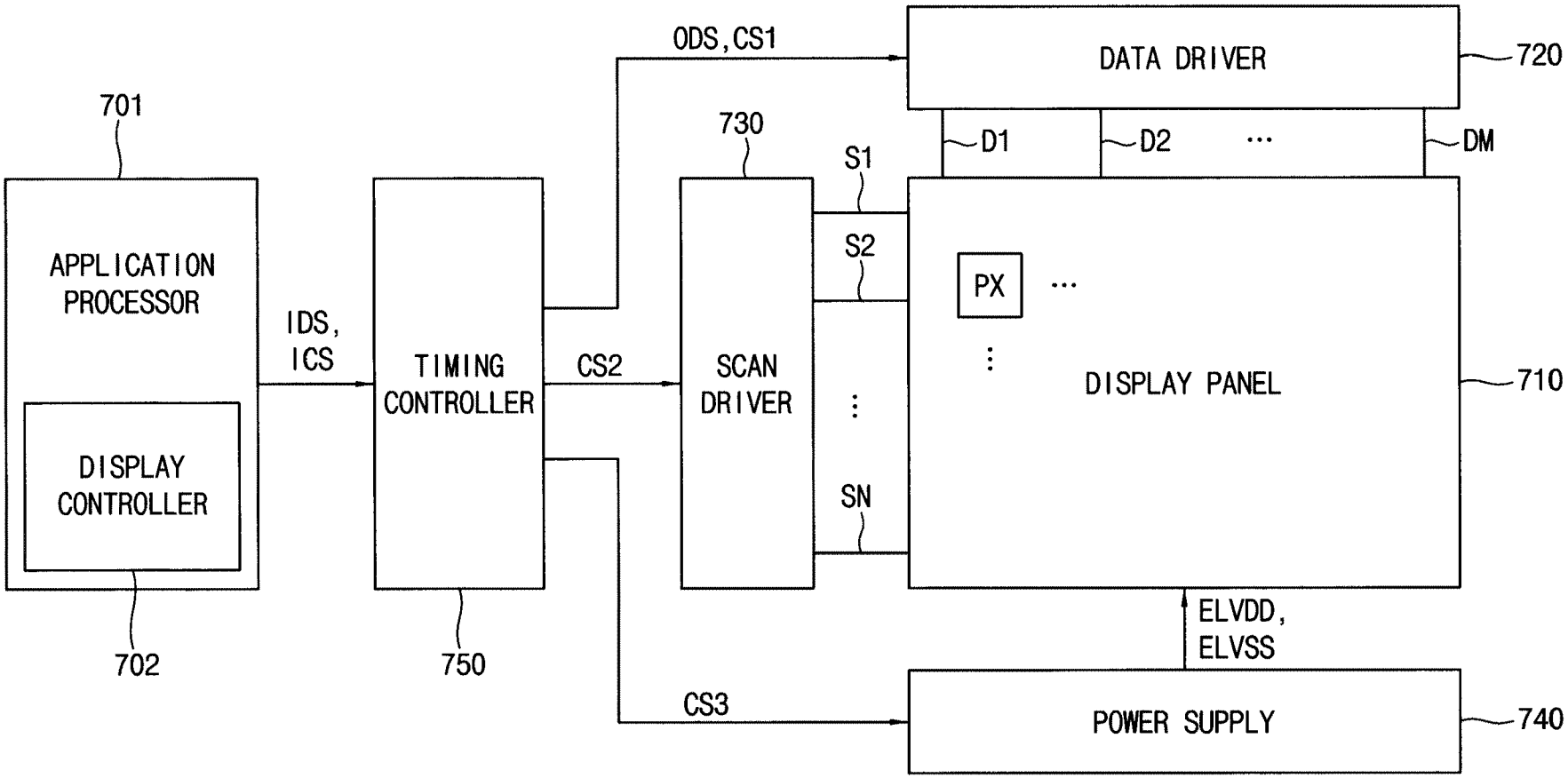
FIG. 14 is a block diagram illustrating an electronic device including an application processor according to an exemplary embodiment.

FIG. 14 is a block diagram illustrating an electronic device including an application processor according to an exemplary embodiment.

Referring to FIG. 14, an electronic device 700 includes an application processor 701 and a display device.

The application processor 701 includes a display controller 702. The application processor 701 may be one of the application processors 500 of FIG. 12 and 600 of FIG. 13, and the display controller 702 may be the display controller 300 of FIG. 11.

The display device includes a display panel 710 and a display driver integrated circuit. The display driver integrated circuit may include a data driver 720, a scan driver 730, a power supply 740 and a timing controller 750.

The display panel 710 operates (e.g., display an image) based on image data. The display panel 710 may be connected to the data driver 720 through a plurality of data lines D1, D2, . . . , DM, and may be connected to the scan driver 730 through a plurality of scan lines S1, S2, SN. The plurality of data lines D1, D2, . . . , DM may extend in a first direction, and the plurality of scan lines S1, S2, . . . , SN may extend in a second direction crossing (e.g., substantially perpendicular to) the first direction.

The display panel 710 may include a plurality of pixels PX arranged in a matrix having a plurality of rows and a plurality of columns. Each of the plurality of pixels PX may include a light emitting element and a driving transistor for driving the light emitting element. Each of the plurality of pixels PX may be electrically connected to a respective one of the plurality of data lines D1, D2, . . . , DM and a respective one of the plurality of scan lines S1, S2, . . . , SN.

In some example embodiments, the display panel 710 may be a self-emitting display panel that emits light without the use of a backlight unit. For example, the display panel 710 may be an organic light-emitting diode (OLED) display panel including an OLED as the light emitting element.

In some example embodiments, each of the plurality of pixels PX included in the display panel 710 may have various configurations according to a driving scheme of the display device. For example, the display device may be driven with an analog or a digital driving scheme. While the analog driving scheme produces grayscale using variable voltage levels corresponding to input data, the digital driving scheme produces grayscale using variable time duration in which the LED emits light. The analog driving scheme is difficult to implement because it requires a driving integrated circuit (IC) that is complicated to manufacture if the display is large and has high resolution. The digital driving scheme, on the other hand, can readily accomplish the required high resolution through a simpler IC structure.

The timing controller 750 controls overall operations of the display device. For example, the timing controller 750 may receive an input control signal ICS from the application processor 701, and may provide predetermined control signals CS1, CS2 and CS3 to the data driver 720, the scan driver 730 and the power supply 740 based on the input control signal ICS to control the operations of the display device. For example, the input control signal ICS may include a master clock signal, a data enable signal, a horizontal synchronization signal, a vertical synchronization signal, and the like. For example, the input control signal ICS may further include the frame rate control signal FRC described with reference to FIG. 11.

The timing controller 750 receives a plurality of input image data IDS from the application processor 701, and generates a plurality of output image data ODS for image display based on the plurality of input image data IDS. For example, the plurality of input image data IDS may include the second image data EDAT described with reference to FIG. 1. For example, the input image data IDS may include red image data, green image data and blue image data. In addition, the input image data IDS may include white image data. Alternatively, the input image data IDS may include magenta image data, yellow image data, cyan image data, and the like. Each of the plurality of input image data IDS and each of the plurality of output image data ODS may correspond to one frame image.

The data driver 720 may generate a plurality of data voltages based on the control signal CS1 and the plurality of output image data ODS from the timing controller 750, and may apply the plurality of data voltages to the display panel 710 through the plurality of data lines D1, D2, . . . , DM. For example, the data driver 720 may include a digital-to-analog converter (DAC) that converts the plurality of output image data ODS in a digital form into the plurality of data voltages in an analog form.

The scan driver 730 may generate a plurality of scan signals based on the control signal CS2 from the timing controller 750, and may apply the plurality of scan signals to the display panel 710 through the plurality of scan lines S1, S2, . . . , SN. The plurality of scan lines S1, S2, . . . , SN may be sequentially activated based on the plurality of scan signals.

In some example embodiments, the data driver 720, the scan driver 730 and the timing controller 750 may be implemented as one integrated circuit (IC). In other example embodiments, the data driver 720, the scan driver 730 and the timing controller 750 may be implemented as two or more integrated circuits. A driving module including at least the timing controller 750 and the data driver 720 may be referred to as a timing controller embedded data driver (TED).

The power supply 740 may supply a first power supply voltage ELVDD and a second power supply voltage ELVSS to the display panel 710 based on the control signal CS3 from the timing controller 750. For example, the first power supply voltage ELVDD may be a high power supply voltage, and the second power supply voltage ELVSS may be a low power supply voltage.

In some example embodiments, at least some of the elements included in the display driver integrated circuit may be disposed, e.g., directly mounted, on the display panel 710, or may be connected to the display panel 710 in a tape carrier package (TCP) type. Alternatively, at least some of the elements included in the display driver integrated circuit may be integrated on the display panel 710. In some example embodiments, the elements included in the display driver integrated circuit may be respectively implemented with separate circuits/modules/chips. In other example embodiments, on the basis of a function, some of the elements included in the display driver integrated circuit may be combined into one circuit/module/chip, or may be further separated into a plurality of circuits/modules/chips.

Figure 15:
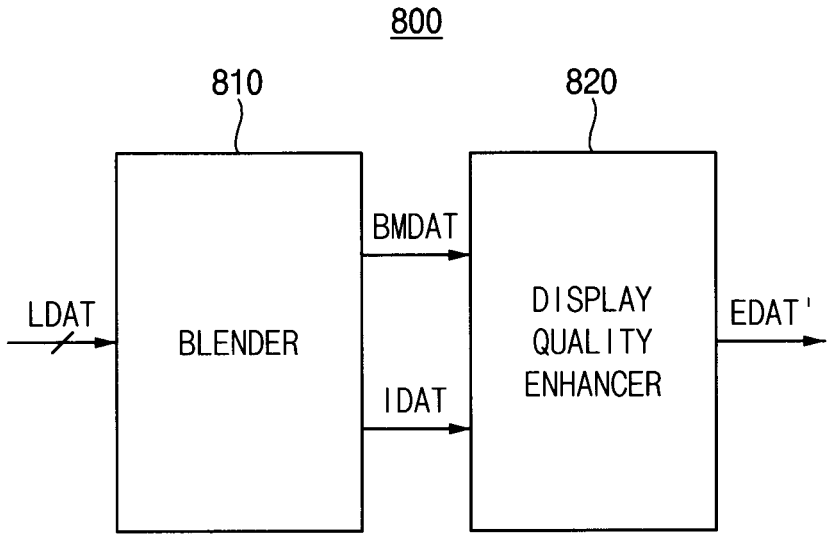
FIG. 15 is a block diagram illustrating an image processing device according to an exemplary embodiment.

FIG. 15 is a block diagram illustrating an image processing device according to an exemplary embodiment. The descriptions already provided with FIG. 1 will not be repeated.

Referring to FIG. 15, an image processing device 800 includes a blender 810 and a display quality enhancer 820.

The blender 810 receives a plurality of layer data LDAT, generates first image data IDAT by blending the plurality of layer data LDAT, and generates block map data BMDAT based on the plurality of layer data LDAT. The blender 810 may be substantially the same as the blender 110 of FIG. 1, except that the blender 810 generates the block map data BMDAT instead of the pixel map data PMDAT.

The block map data BMDAT includes a plurality of block IDs that represent display quality enhancement algorithms to be applied to a plurality of pixel values included in the first image data IDAT. For example, as will be described with reference to FIG. 16, two or more of a plurality of pixels included in a display device are grouped to form a plurality of blocks, and each of the plurality of block IDs corresponds to a respective one of the plurality of blocks. The block ID may be substantially the same as the pixel ID in FIG. 1, except that the block ID corresponds to one block, not to one pixel.

The display quality enhancer 820 generates second image data EDAT' by applying different display quality enhancement algorithms to at least some of the plurality of pixel values based on the first image data IDAT and the block map data BMDAT. As with the second image data EDAT in FIG. 1, the second image data EDAT' includes a plurality of display quality enhancement pixel values. Unlike the second image data EDAT in FIG. 1, the same display quality enhancement algorithm may be applied to pixel values corresponding to the same block based on the same block ID.

The image processing device 800 may have a configuration similar to that illustrated in FIG. 2. For example, the blender 810 may include a blending block and a block map generator, and the display quality enhancer 820 may include a plurality of registers, a multiplexer and an enhancement block. In addition, the image processing device 800 may operate similarly to the operations described with reference to FIGS. 3 through 10, and may be included in a display controller, an application processor and/or an electronic device as described with reference to FIGS. 11 through 14.

FIG. 16 is a diagram for describing an operation of an image processing device according to an exemplary embodiment.

Referring to FIG. 16, a block map BMAP generated corresponding to one composite image (e.g., the composite image CIMG of FIG. 4) displayed on the display device 200 of FIG. 3 is illustrated.

In an example of FIG. 16, two pixels may form one block, and the block map BMAP may include a plurality of block IDs BID_11, BID_12, BID_13, BID_14, BID_15, BID_16, BID_17, BID_18, BID_21, BID_22, BID_23, BID_24, BID_25, BID_26, BID_27, BID_28, BID_31, BID_32, BID_33, BID_34, BID_35, BID_36, BID_37, BID_38, BID_41, BID_42, BID_43, BID_44, BID_45, BID_46, BID_47, BID_48, BID_51, BID_52, BID_53, BID_54, BID_55, BID_56, BID_57, BID_58, BID_61, BID_62, BID_63, BID_64, BID_65, BID_66, BID_67 and BID_68 that correspond to a plurality of blocks.

When a composite image having improved display quality is generated by applying different optimal display quality enhancement algorithms to the composite image (e.g., the composite image CIMG of FIG. 4) by units of blocks based on the block map BMAP, pixel values of the pixels P11 and P21, for example, may be generated by applying at least one display quality enhancement algorithm selected based on the block ID BID_11, and pixel values of the pixels P12 and P22 may be generated by applying at least one display quality enhancement algorithm selected based on the block ID BID_12. The display quality enhancement algorithm applied to the pixel values of the pixels P11 and P21 and the display quality enhancement algorithm applied to the pixel values of the pixels P12 and P22 may be the same as or different from each other. That is, at least one display quality enhancement algorithm configured to process each block may cover wider range of pixels, thereby increasing speed of processing each pixel.

Although example embodiments are described based on a specific number of pixels, blocks and block IDs, example embodiments are not limited thereto.

Figure 17:
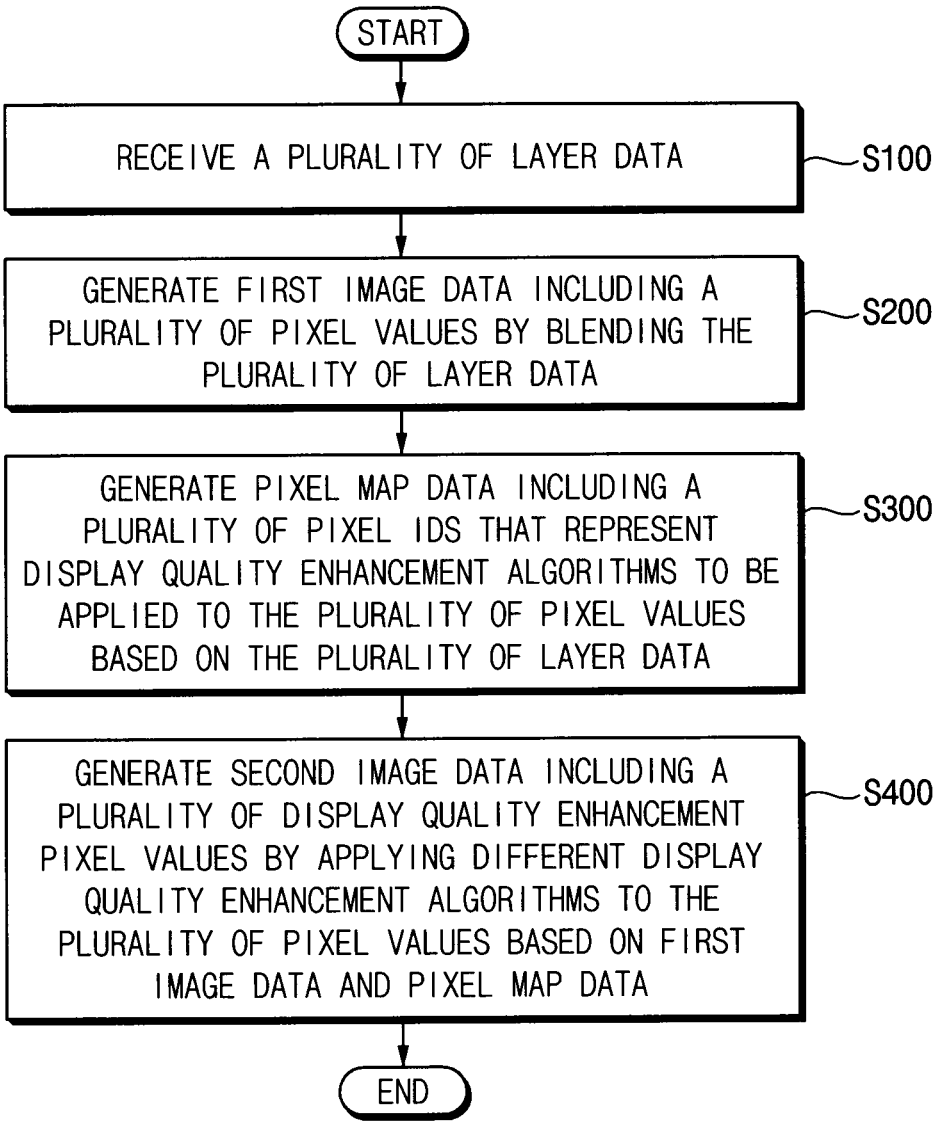
FIG. 17 is a flowchart illustrating an image processing method according to an exemplary embodiment.

FIG. 17 is a flowchart illustrating an image processing method according to an exemplary embodiment.

Referring to FIGS. 1 and 17, in an image processing method according to example embodiments, a plurality of layer data LDAT are received (step S100). The plurality of layer data LDAT represent a plurality of images to be displayed on one screen in a display device. First image data IDAT is generated by blending the plurality of layer data LDAT (step S200). The first image data IDAT includes a plurality of pixel values corresponding to the one screen. Pixel map data PMDAT is generated based on the plurality of layer data LDAT (step S300). The pixel map data PMDAT includes a plurality of pixel identifications (IDs) that indicate display quality enhancement algorithms to be applied to the plurality of pixel values. Here, steps S100, S200 and S300 may be performed by the blender 110 shown in FIG. 1 or other blenders according to the one or more embodiments.

Second image data EDAT is generated by applying different display quality enhancement algorithms to the plurality of pixel values based on the first image data IDAT and the pixel map data PMDAT (step S400). The second image data EDAT includes a plurality of display quality enhancement pixel values. Step S400 may be performed by the display quality enhancer 120 of FIG. 1, or other display quality enhancer according to the one or more embodiments.

Figure 18:
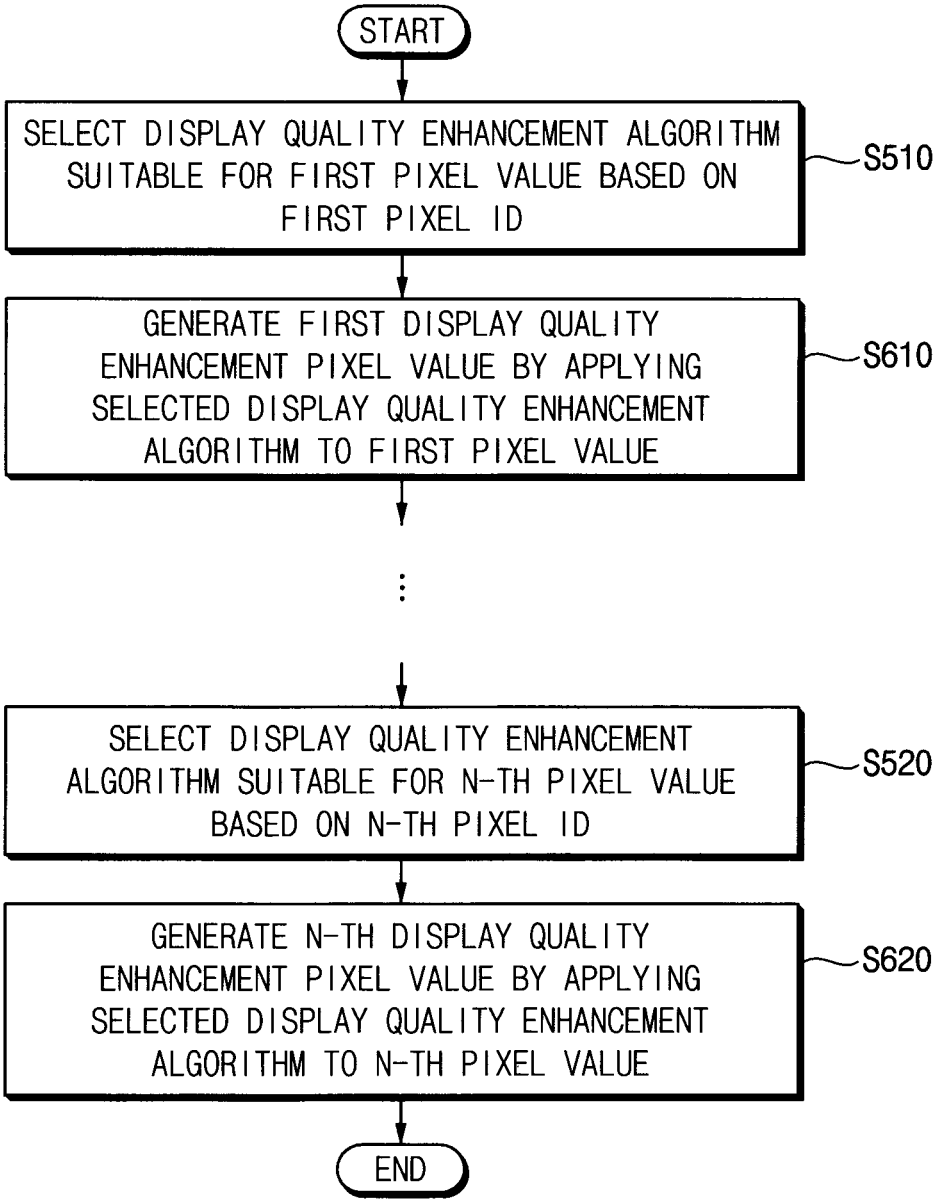
FIGS. 18 and 19 are flowcharts illustrating examples of generating second image data in FIG. 17.
Figure 19:
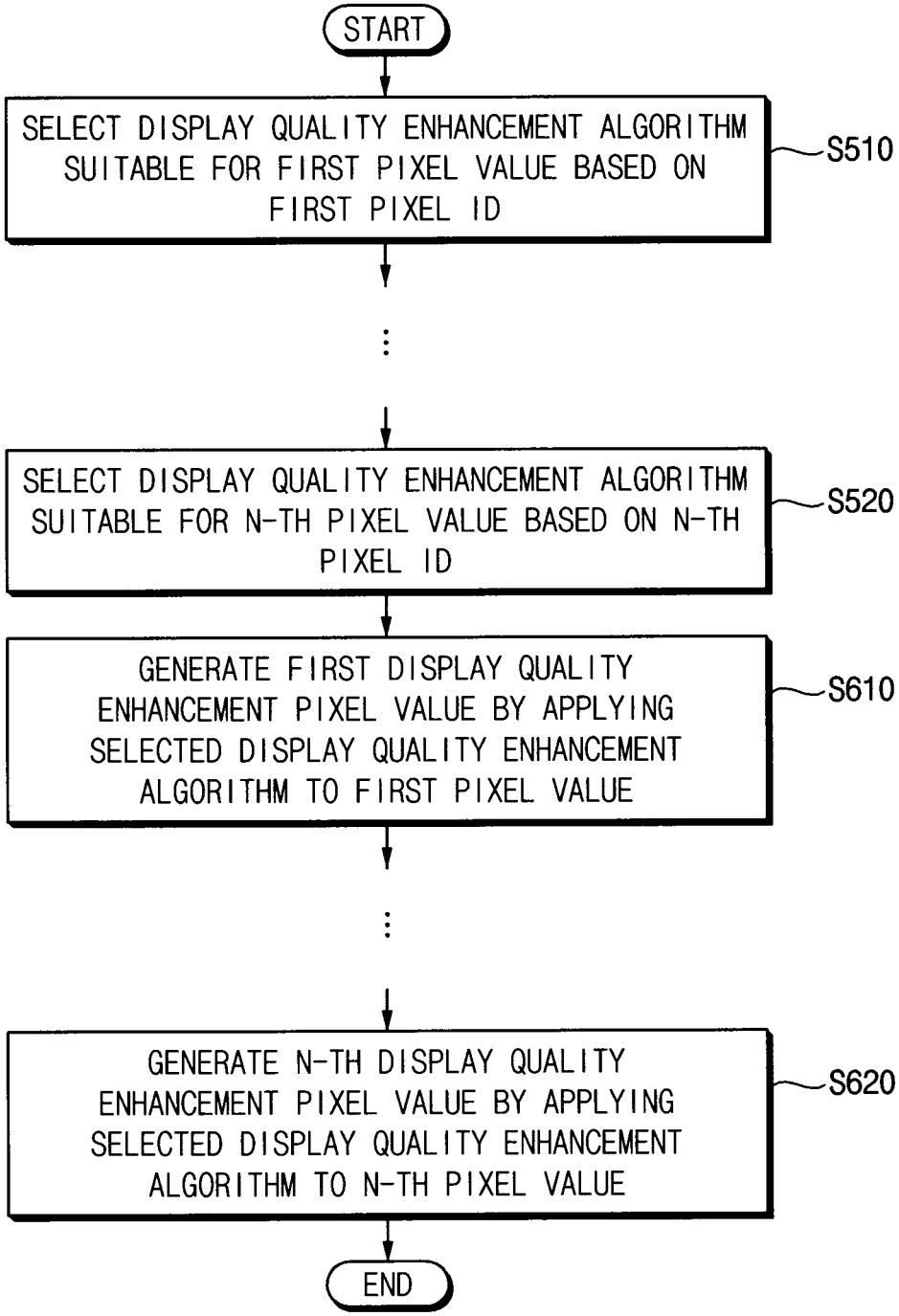

FIGS. 18 and 19 are flowcharts illustrating examples of generating second image data in FIG. 17.

Referring to FIGS. 2, 17 and 18, when generating the second image data EDAT (step S400), at least one display quality enhancement algorithm for a first pixel value PV1 may be selected based on a first pixel ID PID1 (step S510), and a first display quality enhancement pixel value EPV1 may be generated by applying the at least one display quality enhancement algorithm selected by step S510 to the first pixel value PV1 (step S610). After that, at least one display quality enhancement algorithm for an N-th pixel value PVN may be selected based on an N-th pixel ID PIDN (step S520), and an N-th display quality enhancement pixel value EPVN may be generated by applying the at least one display quality enhancement algorithm selected by step S520 to the N-th pixel value PVN (step S620). In other words, an example of FIG. 18 illustrates that an operation of selecting a display quality enhancement algorithm and an operation of generating a display quality enhancement pixel value are sequentially performed for each pixel value.

Referring to FIGS. 2, 17 and 19, when generating the second image data EDAT (step S400), at least one display quality enhancement algorithm for a first pixel value PV1 may be selected based on a first pixel ID PID1 (step S510), and at least one display quality enhancement algorithm for an N-th pixel value PVN may be selected based on an N-th pixel ID PIDN (step S520). Subsequently, a first display quality enhancement pixel value EPV1 may be generated by applying the at least one display quality enhancement algorithm selected in step S510 to the first pixel value PV1 (step S610), and an N-th display quality enhancement pixel value EPVN may be generated by applying the at least one display quality enhancement algorithm selected in step S520 to the N-th pixel value PVN (step S620). An example of FIG. 19 illustrates that an operation of selecting a display quality enhancement algorithm is sequentially performed for all pixel values, and then an operation of generating a display quality enhancement pixel value is sequentially performed on all pixel values.

Figure 20:
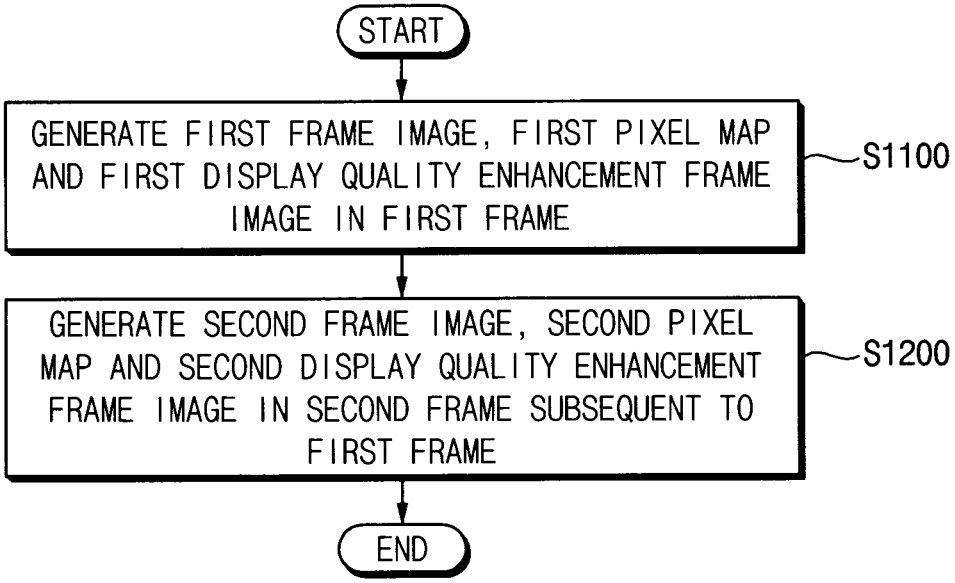
FIGS. 20, 21 and 22 are flowcharts illustrating an image processing method according to exemplary embodiments.
Figure 21:
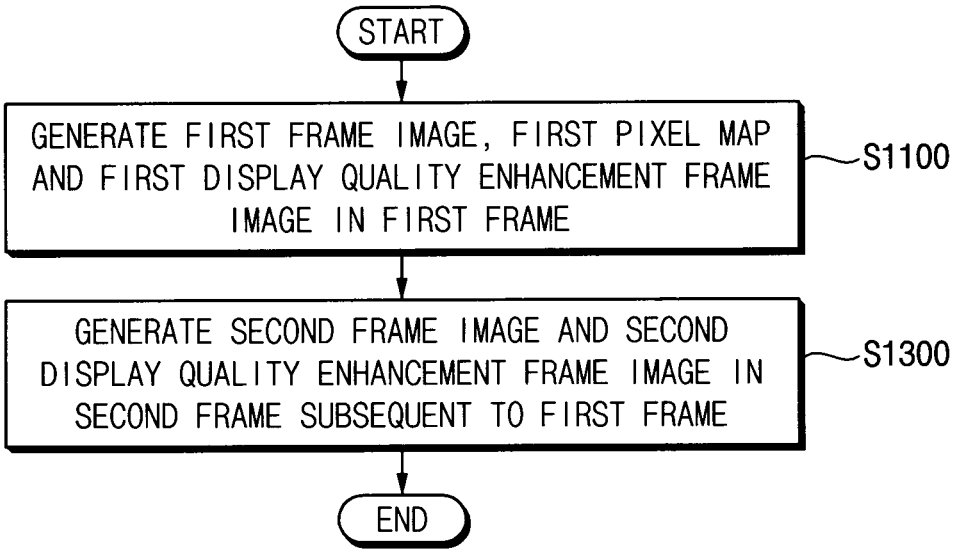
Figure 22:
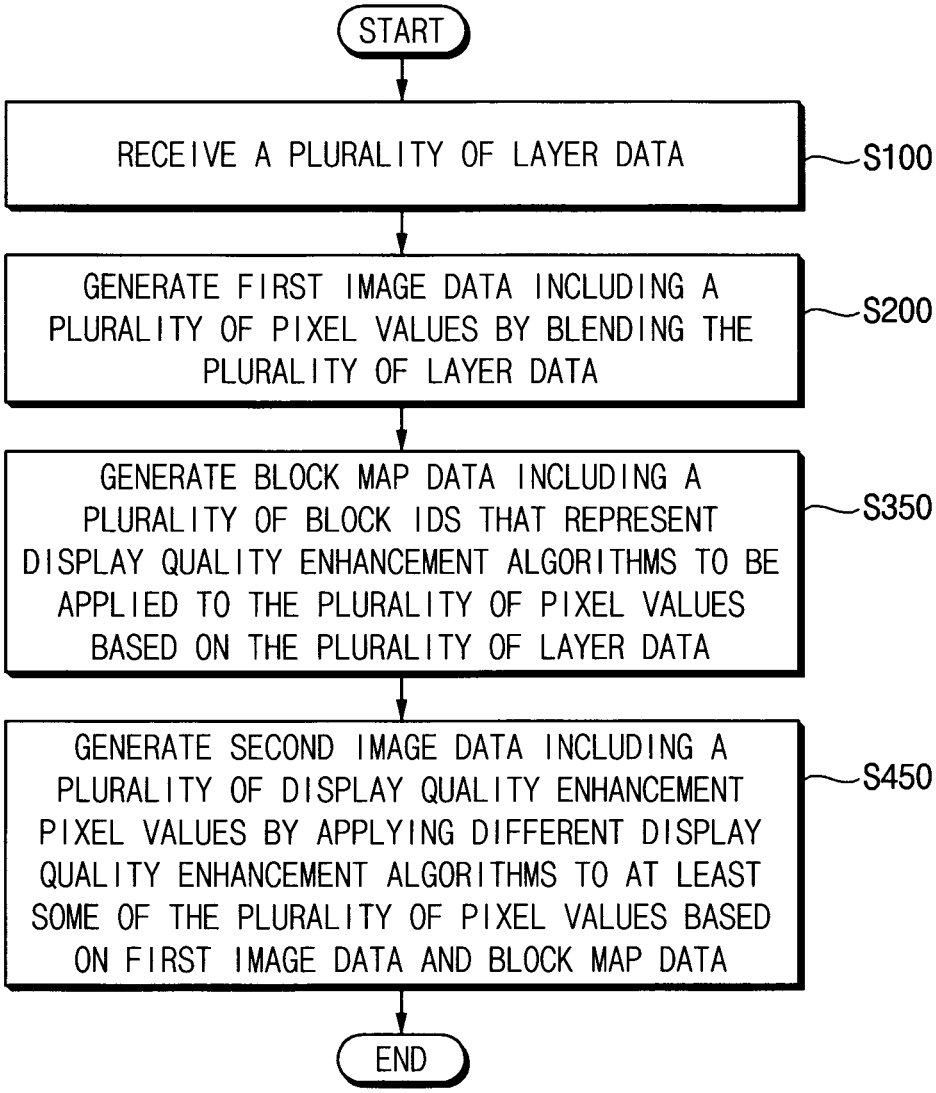

FIGS. 20, 21 and 22 are flowcharts illustrating an image processing method according to exemplary embodiments. The descriptions provided above with respect to FIG. 17 will not be repeated.

Referring to FIGS. 10A and 20, in an image processing method according to example embodiments, a first frame image F1, a first pixel map PM1 and a first display quality enhancement frame image EF1 are generated in a first frame (step S1100). A second frame image F2, a second pixel map PM2 and a second display quality enhancement frame image EF2 are generated in a second frame subsequent to the first frame (step S1200). Each of steps S1100 and S1200 may be performed based on steps S100, S200, S300 and S400 in FIG. 17. An example of FIG. 20 illustrates that image data and pixel map data are generated for each frame.

Referring to FIGS. 10B and 21, in an image processing method according to example embodiments, step S1100 may be substantially the same as step S1100 in FIG. 20. A second frame image F2 and a second display quality enhancement frame image EF2' may be generated in a second frame subsequent to the first frame (step S1300). Step S1300 may be performed based on steps S100, S200 and S400 in FIG. 17. In the second frame, the second pixel map PM2 may not be generated, and the second display quality enhancement frame image EF2' may be generated based on the second frame image F2 that is currently generated and the first pixel map PM1 that is previously generated. An example of FIG. 21 illustrates that image data is generated for each frame and pixel map data is generated for X frames.

Referring to FIGS. 15 and 22, in an image processing method according to example embodiments, steps S100 and S200 may be substantially the same as steps S100 and S200 in FIG. 17, respectively. In contrast to the embodiment described with respect to FIG. 17, in FIG. 22, block map data BMDAT is generated based on the plurality of layer data LDAT (step S350). The block map data BMDAT includes a plurality of block IDs that indicate display quality enhancement algorithms to be applied to the plurality of blocks including one or more pixel values. Steps S100, S200 and S350 may be performed by the blender 810.

Second image data EDAT' is generated by applying different display quality enhancement algorithms to at least some of the plurality of pixel values based on the first image data IDAT and the block map data BMDAT (step S450). The second image data EDAT' includes a plurality of display quality enhancement pixel values. Step S450 may be performed by the display quality enhancer 820. The same display quality enhancement algorithm may be applied to pixel values corresponding to the same block based on the same block ID.

As will be appreciated by those skilled in the art, the inventive concept may be embodied as a system, method, computer program product, and/or a computer program product embodied in one or more computer readable medium(s) having computer readable program code stored thereon. The computer readable program code may be accessed by a processor of a computer or other programmable data processing apparatus. The computer readable medium may be a computer readable signal medium or a computer readable storage medium. The computer readable storage medium may be any tangible medium that can contain or store a program for use by or in connection with an instruction execution system, apparatus, or device. For example, the computer readable medium may be a non-transitory computer readable medium.

Figure 23:
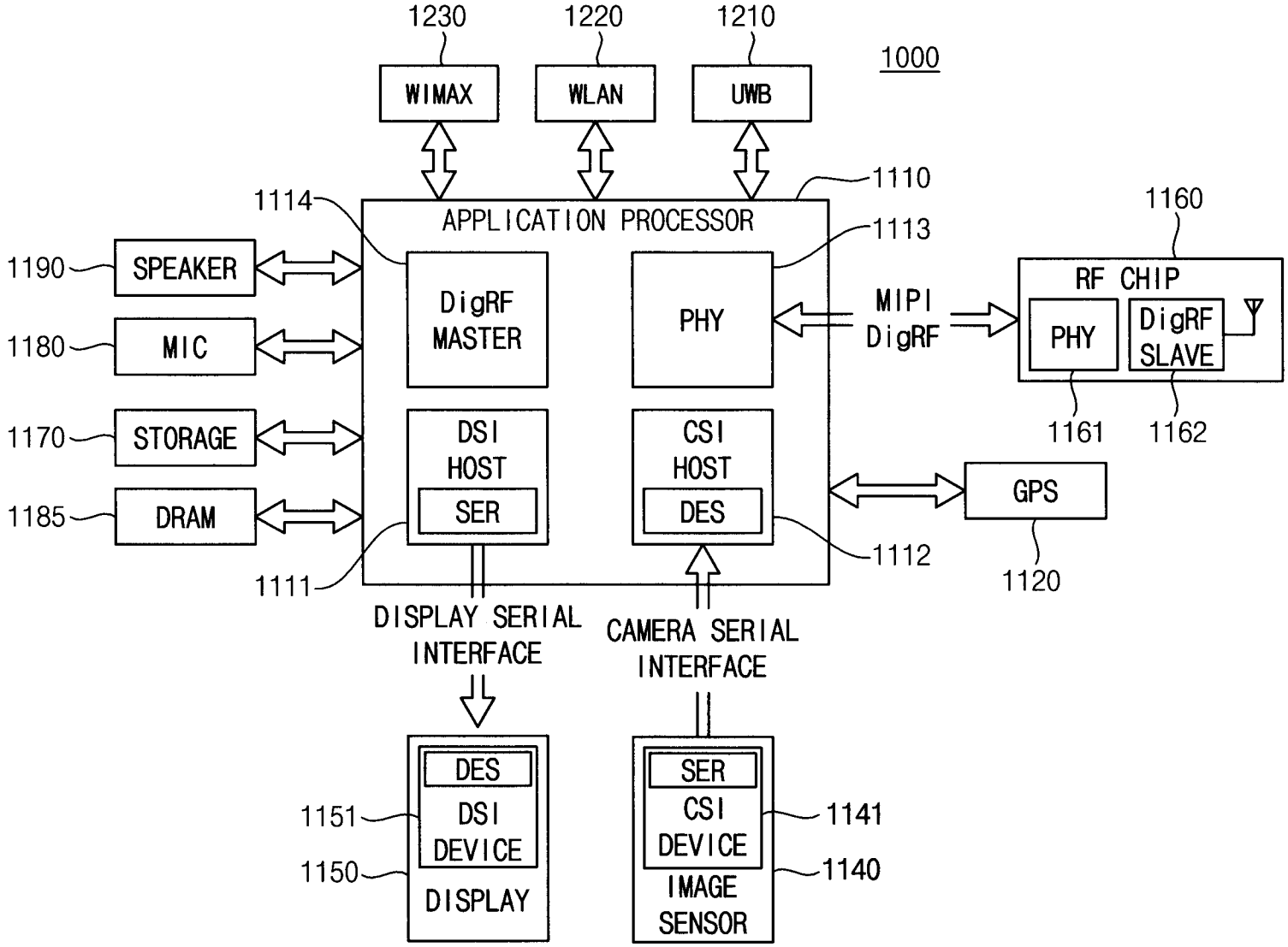
FIG. 23 is a block diagram illustrating an electronic system including an application processor according to an exemplary embodiment.

FIG. 23 is a block diagram illustrating an electronic system including an application processor according to an exemplary embodiment.

Referring to FIG. 23, an electronic system 1000 may be implemented as a data processing device that uses or supports a mobile industry processor interface (MIPI) interface. The electronic system 1000 may include an application processor 1110, an image sensor 1140, a display device 1150, etc. The electronic system 1000 may further include a radio frequency (RF) chip 1160, a global positioning system (GPS) 1120, a storage 1170, a microphone (MIC) 1180, a dynamic random access memory (DRAM) 1185 and a speaker 1190. In addition, the electronic system 1000 may perform communications using an ultra-wideband (UWB) 1210, a wireless local area network (WLAN) 1220, a worldwide interoperability for microwave access (WIMAX) 1230, etc.

The application processor 1110 may be a controller or a processor that controls operations of the image sensor 1140 and the display device 1150.

The application processor 1110 may include a display serial interface (DSI) host 1111 that performs a serial communication with a DSI device 1151 of the display device 1150, a camera serial interface (CSI) host 1112 that performs a serial communication with a CSI device 1141 of the image sensor 1140, a physical layer (PHY) 1113 that performs data communications with a PHY 1161 of the RF chip 1160 based on a MIPI DigRF, and a DigRF MASTER 1114 that controls the data communications of the physical layer 1161. A DigRF SLAVE 1162 of the RF chip 1160 may be controlled through the DigRF MASTER 1114.

In some example embodiments, the DSI host 1111 may include a serializer (SER), and the DSI device 1151 may include a deserializer (DES). In some example embodiments, the CSI host 1112 may include a deserializer (DES), and the CSI device 1141 may include a serializer (SER).

The application processor 1110 and the DSI host 1111 may be the application processor and the display controller according to example embodiments, and may include the image processing device according to example embodiments.

The one or more inventive concepts may be applied to various devices and systems that include the image processing devices and the display devices. For example, the inventive concept may be applied to systems such as a personal computer (PC), a server computer, a data center, a workstation, a mobile phone, a smart phone, a tablet computer, a laptop computer, a personal digital assistant (PDA), a portable multimedia player (PMP), a digital camera, a portable game console, a music player, a camcorder, a video player, a navigation device, a wearable device, an internet of things (IoT) device, an internet of everything (IoE) device, an e-book reader, a virtual reality (VR) device, an augmented reality (AR) device, a robotic device, a drone, etc.

The foregoing is illustrative of example embodiments and is not to be construed as limiting the scope of the one or more embodiments of the disclosure. Although some example embodiments have been described, those skilled in the art will readily appreciate that many modifications, substitutions, and improvements can be made to the example embodiments without materially departing from the novel teachings and advantages of the example embodiments. Accordingly, all such modifications, substitutions and improvements should be construed as falling within the scope of the example embodiments as defined in the following claims.

What is claimed is:

1. An image processing device comprising at least one processor configured to implement:

a blender configured to:

receive a plurality of layer data;

generate first image data by blending the plurality of layer data, the first image data including a plurality of pixel values corresponding to one screen in a display device; and generate pixel map data including a plurality of pixel identifications (IDs) based on the plurality of layer data, the plurality of layer data representing a plurality of images to be displayed on the one screen in the display device, the plurality of pixel IDs indicating one or more display quality enhancement algorithms to be applied to the plurality of pixel values, wherein the blender comprises:

a blending block configured to generate the plurality of pixel values corresponding to one composite image to be displayed on the one screen by synthesizing the plurality of images based on the plurality of layer data; and a pixel map generator configured to generate the plurality of pixel IDs for the plurality of pixel values corresponding to the one composite image based on the plurality of layer data; and a display quality enhancer configured to generate second image data including a plurality of display quality enhancement pixel values by applying the one or more display quality enhancement algorithms to the plurality of pixel values based on the first image data and the pixel map data.

2. The image processing device of claim 1, wherein:

the plurality of pixel values include a first pixel value through an N-th pixel value, where N is a natural number greater than or equal to two;

the plurality of pixel IDs include a first pixel ID through an N-th pixel ID;

the plurality of display quality enhancement pixel values include a first display quality enhancement pixel value through an N-th display quality enhancement pixel value; and the display quality enhancer is further configured to:

select a first display quality enhancement algorithm among the one or more display quality enhancement algorithms based on the first pixel ID; and generate the first display quality enhancement pixel value by applying the first display quality enhancement algorithm to the first pixel value among the plurality of pixel values.

3. The image processing device of claim 2, wherein the display quality enhancer is further configured to:

select a second display quality enhancement algorithm different from the first display quality enhancement algorithm among the one or more display quality enhancement algorithms based on a second pixel ID; and generate a second display quality enhancement pixel value by applying the second display quality enhancement algorithm to a second pixel value among the plurality of pixel values.

4. The image processing device of claim 2, wherein the display quality enhancer is further configured to:

select a second display quality enhancement algorithm different from the first display quality enhancement algorithm among the one or more display quality enhancement algorithms based on the first pixel ID; and generate the first display quality enhancement pixel value by applying the first display quality enhancement algorithm and the second display quality enhancement algorithm to the first pixel value.

5. The image processing device of claim 2, wherein:

the plurality of images include a first image through a K-th image, where K is a natural number greater than or equal to two;

the plurality of layer data include first layer data through K-th layer data; and based on the first image and a second image being overlapped and disposed on a first region of the one screen including a first pixel, the blender is further configured to generate the first pixel ID based on one of the first layer data representing the first image and second layer data representing the second image.

6. The image processing device of claim 5, wherein, based on the first image being disposed to be displayed on the first region, the blender is further configured to generate the first pixel ID based on the first layer data.

7. The image processing device of claim 1, wherein one or more of the plurality of pixel IDs corresponding to layer data among the plurality of layer data have a same pixel ID.

8. The image processing device of claim 1, wherein one or more of the plurality of pixel IDs corresponding to layer data among the plurality of layer data have different pixel IDs from each other.

9. The image processing device of claim 1, wherein the display quality enhancer comprises:

a plurality of registers configured to store a plurality of display quality enhancement parameters for a plurality of display quality enhancement algorithms;

a multiplexer configured to select at least one of the plurality of display quality enhancement algorithms based on the plurality of pixel IDs; and an enhancement block configured to generate the plurality of display quality enhancement pixel values based on the plurality of pixel values and the at least one of the plurality of display quality enhancement algorithms.

10. The image processing device of claim 1, wherein:

the image processing device is further configured to receive at least one meta data corresponding to at least one of the plurality of layer data; and the blender is further configured to generate the pixel map data based on the plurality of layer data and the at least one meta data.

11. The image processing device of claim 10, further comprising a frame rate control unit configured to control a frame rate of the image processing device based on the at least one meta data.

12. The image processing device of claim 1, wherein the plurality of layer data are provided from one or more external data processing devices.

13. The image processing device of claim 1, wherein:

the blender is further configured to selectively generate pixel IDs for some of the plurality of pixel values; and the display quality enhancer is further configured to generate some of the plurality of display quality enhancement pixel values by applying the one or more display quality enhancement algorithms to some of the plurality of pixel values.

14. The image processing device of claim 1, wherein the blender is further configured to generate the first image data and the pixel map data for each frame.

15. The image processing device of claim 1, wherein the blender is further configured to generate the first image data for each frame, and generate the pixel map data for X frames, where X is a natural number greater than or equal to two.

16. An image processing method comprising:

receiving a plurality of layer data, the plurality of layer data representing a plurality of images to be displayed on one screen in a display device;

generating first image data by blending the plurality of layer data, the first image data including a plurality of pixel values corresponding to the one screen;

generating pixel map data including a plurality of pixel identifications (IDs) based on the plurality of layer data, the plurality of pixel IDs indicating one or more display quality enhancement algorithms to be applied to the plurality of pixel values;

generating the plurality of pixel values corresponding to one composite image to be displayed on the one screen by synthesizing the plurality of images based on the plurality of layer data;

generating the plurality of pixel IDs for the plurality of pixel values corresponding to the one composite image based on the plurality of layer data; and generating second image data including a plurality of display quality enhancement pixel values by applying the one or more display quality enhancement algorithms to the plurality of pixel values based on the first image data and the pixel map data.

17. The image processing method of claim 16, wherein:

the plurality of pixel values include a first pixel value through an N-th pixel value, where N is a natural number greater than or equal to two;

the plurality of pixel IDs include a first pixel ID through an N-th pixel ID;

the plurality of display quality enhancement pixel values include a first display quality enhancement pixel value through an N-th display quality enhancement pixel value; and wherein the generating the second image data including the plurality of display quality enhancement pixel values comprises:

selecting a first display quality enhancement algorithm among the one or more display quality enhancement algorithms for the first pixel value based on the first pixel ID and generating the first display quality enhancement pixel value based on the first pixel value; and selecting an N-th display quality enhancement algorithm for the N-th pixel value based on the N-th pixel ID and generating the N-th display quality enhancement pixel value based on the N-th pixel value.

18. The image processing method of claim 16, wherein:

the plurality of pixel values include a first pixel value through an N-th pixel value, where N is a natural number greater than or equal to two;

the plurality of pixel IDs include a first pixel ID through an N-th pixel ID;

the plurality of display quality enhancement pixel values include a first display quality enhancement pixel value through an N-th display quality enhancement pixel value; and wherein the generating the second image data including the plurality of display quality enhancement pixel values comprises:

selecting one or more display quality enhancement algorithms for the first pixel value through the N-th pixel value based on the first pixel ID through the N-th pixel ID; and generating the first display quality enhancement pixel value through the N-th display quality enhancement pixel value based on the first pixel value through the N-th pixel value.

19. An application processor comprising:

at least one processor; and a display controller configured to be interoperable with the at least one processor, wherein the display controller comprises:

a high dynamic range (HDR) unit configured to receive a plurality of layer data from the at least one processor, and to perform a HDR processing on the plurality of layer data based on a first control signal, the plurality of layer data representing a plurality of images to be displayed on one screen in a display device;

a blender configured to generate first image data by blending the plurality of layer data based on an output of the HDR unit and a second control signal, and to generate pixel map data including a plurality of pixel identifications (IDs) based on the output of the HDR unit and the second control signal, the first image data including a plurality of pixel values corresponding to the one screen, the plurality of pixel IDs indicating one or more display quality enhancement algorithms to be applied to the plurality of pixel values;

a display quality enhancer configured to generate second image data including a plurality of display quality enhancement pixel values by applying the one or more display quality enhancement algorithms to the plurality of pixel values based on the first image data and the pixel map data;

a register configured to receive at least one meta data corresponding to at least one of the plurality of layer data from the at least one processor, and to generate the first control signal, the second control signal and a third control signal based on the at least one meta data; and a frame rate control unit configured to control a frame rate of the display device based on the third control signal.

20. An image processing device comprising at least one processor configured to implement:

a blender configured to:

receive a plurality of layer data;

generate first image data by blending the plurality of layer data, the first image data including a plurality of pixel values corresponding to one screen of a display device; and generate block map data including a plurality of block identifications (IDs) based on the plurality of layer data, the plurality of layer data representing a plurality of images to be displayed on the one screen of the display device, the plurality of block IDs indicating one or more display quality enhancement algorithms to be applied to the plurality of pixel values; and a display quality enhancer configured to generate second image data including a plurality of display quality enhancement pixel values by applying the one or more display quality enhancement algorithms to a plurality of blocks based on the first image data and the block map data, wherein the display device includes a plurality of pixels, and each of the plurality of pixel values correspond to a respective one of the plurality of pixels, and wherein two or more of the plurality of pixels are grouped to form each of the plurality of blocks, and each of the plurality of block IDs corresponds to a respective one of the plurality of blocks.

* * * * *